US011594093B2

(12) United States Patent
Chen et al.

(10) Patent No.: US 11,594,093 B2
(45) Date of Patent: Feb. 28, 2023

(54) MONEY PROCESSING SYSTEM AND MONEY PROCESSING METHOD

(71) Applicant: GLORY LTD., Himeji (JP)

(72) Inventors: Yang Chen, Himeji (JP); Kazuhiro Doi, Himeji (JP); Kazutoshi Nakagawa, Himeji (JP)

(73) Assignee: GLORY LTD.

( * ) Notice: Subject to any disclaimer, the term of this patent is extended or adjusted under 35 U.S.C. 154(b) by 335 days.

(21) Appl. No.: 16/801,348

(22) Filed: Feb. 26, 2020

(65) Prior Publication Data

US 2020/0273280 A1 Aug. 27, 2020

(30) Foreign Application Priority Data

Feb. 27, 2019 (JP) ..... JP2019-033640

(51) Int. Cl.

| | |
|---|---|
| ***G07D 11/00*** | (2019.01) |
| ***G07D 11/245*** | (2019.01) |
| ***G07D 11/16*** | (2019.01) |
| ***G07D 11/30*** | (2019.01) |
| ***G07D 9/00*** | (2006.01) |

(52) U.S. Cl.

CPC ..... *G07D 11/0087* (2013.01); *G07D 9/00* (2013.01); *G07D 11/16* (2019.01); *G07D 11/245* (2019.01); *G07D 11/30* (2019.01); *G07D 2211/00* (2013.01)

(58) Field of Classification Search

CPC ..... G07D 11/0087; G07D 9/00; G07D 11/16; G07D 11/245; G07D 11/30; G07D 2211/00; G07D 11/34

USPC ..... 235/379

See application file for complete search history.

(56) References Cited

U.S. PATENT DOCUMENTS

| | | | | |
|---|---|---|---|---|
| 4,775,783 | A | 10/1988 | Sasaki et al. | |
| 5,799,288 | A | 8/1998 | Tanaka et al. | |
| 6,014,649 | A | 1/2000 | Kobayashi et al. | |
| 7,954,699 | B1 * | 6/2011 | Sanders | G07D 11/0096 235/383 |
| 8,225,988 | B1 | 7/2012 | Bohen et al. | |

(Continued)

FOREIGN PATENT DOCUMENTS

| | | | |
|---|---|---|---|
| EP | 2 731 086 | A1 | 5/2014 |
| JP | H08-101944 | A | 4/1996 |

(Continued)

OTHER PUBLICATIONS

JP 2012164282A—Change machine system, English machine translation, 23 pages (Year: 2022).*

(Continued)

*Primary Examiner* — Tuyen K Vo

(74) *Attorney, Agent, or Firm* — Foley & Lardner LLP

(57) ABSTRACT

Provided is a money processing system realizing easy movement of money between a plurality of money handling apparatuses. A money processing system including a plurality of money handling apparatuses further includes a management apparatus configured to detect a money handling apparatus that requires movement of money, and select, from among the plurality of money handling apparatuses, one or a plurality of money handling apparatuses to move the money between the detected money handling apparatus and the selected one or the plurality of handling apparatuses.

18 Claims, 15 Drawing Sheets

(56) References Cited

U.S. PATENT DOCUMENTS

| | | | | |
|---|---|---|---|---|
| 9,070,125 | B1 * | 6/2015 | Folk | G07F 7/04 |
| 9,905,086 | B1 | 2/2018 | Phillips et al. | |
| 10,217,329 | B1 * | 2/2019 | Phillips | G07F 19/202 |
| 10,977,889 | B1 * | 4/2021 | McCabe | G07D 11/32 |
| 2004/0217162 | A1 | 11/2004 | Chigira et al. | |
| 2010/0131407 | A1 | 5/2010 | Folk et al. | |
| 2010/0211437 | A1 | 8/2010 | Schneider et al. | |
| 2019/0147707 | A1 * | 5/2019 | Phillips | G07F 19/206 235/379 |

FOREIGN PATENT DOCUMENTS

| | | | | |
|---|---|---|---|---|
| JP | 09-134470 | A | | 5/1997 |
| JP | 2000-339521 | A | | 12/2000 |
| JP | 2012164282 | A | * | 8/2012 |
| JP | 2016-040696 | A | | 3/2016 |
| JP | 2017-97866 | A | | 6/2017 |
| JP | 2018-036807 | A | | 3/2018 |
| JP | 6460139 | B2 | | 1/2019 |

OTHER PUBLICATIONS

Australian Office Action, Application No. 2020201362, dated Sep. 28, 2020, 7 pages.
Extended European Search Report, Application No. 20159513.9, dated Jun. 26, 2020, 9 pages.
Japanese Office Action dated Nov. 1, 2022 in connection with JP Appl. Ser. No. 2019-033640.

* cited by examiner

MONEY PROCESSING SYSTEM AND MONEY PROCESSING METHOD

BACKGROUND OF THE INVENTION

Field of the Invention

The present invention relates to a money processing system and a money processing method.

Description of the Background Art

Conventionally, a plurality of money handling apparatuses have been used in a store. For example, at a checkout counter, a depositing/dispensing apparatus capable of performing depositing of money and dispensing of change is used as a change dispenser. In a back office of the store, a depositing/dispensing apparatus is used for dispensing money to replenish the change dispenser and for depositing money collected from the change dispenser. A money changer that allows visiting customers to change money may be used in the store.

When shortage or surplus of money occurs in a money handling apparatus, the apparatus becomes incapable of handling money. When shortage of money occurs, a person in charge of managing money in the store requests a cash-in-transit (CIT) company for delivery of money, and replenishes the money handling apparatus with money delivered to the store. When surplus of money occurs, the person in charge requests the CIT company for collection of surplus money from the store.

For example, Japanese Laid-Open Patent Publication No. 2017-97866 discloses a technique of managing the inventory amounts of money in money handling apparatuses installed in a store, and sharing data of the inventory amounts with a server of a CIT company. This technique allows the CIT company to know shortage and surplus of money that occurred in the store and transport money for the store. Thus, a burden on a person in charge of the store is reduced.

SUMMARY OF THE INVENTION

However, requesting a CIT company for transportation of money incurs a service charge. Therefore, in order to reduce the number of requests to the CIT company, it is preferable that the person in charge of the store moves money to an apparatus in which shortage of money occurs from another apparatus, and moves money from an apparatus in which surplus of money occurs to another apparatus. In the conventional technique, although a plurality of money handling apparatuses are used in the store, movement of money between the apparatuses cannot be easily performed.

The present invention is made in view of the problem of the conventional art, and an object of the present invention is to provide a money processing system and a money processing method which enable easy movement of money between a plurality of money handling apparatuses.

In order to solve the above problem and achieve the object, a money processing system according to one aspect of the present invention includes: a plurality of money handling apparatuses; and a management apparatus configured to detect a money handling apparatus that requires movement of money, and select, from among the plurality of money handling apparatuses, one or a plurality of money handling apparatuses to move the money between the detected money handling apparatus and the selected one or the plurality of handling apparatuses.

A money processing method to be executed by a management apparatus according to another aspect of the present invention, includes: detecting a money handling apparatus that requires movement of money; and selecting, from among a plurality of money handling apparatuses, one or a plurality of money handling apparatuses to move the money between the detected money handling apparatus and the selected one or a plurality of money handling apparatuses.

The above and other objects, features, advantages and technical and industrial significance of this invention will be better understood by reading the following detailed description of presently preferred embodiments of the invention, when considered in connection with the accompanying drawings.

DESCRIPTION OF THE PREFERRED EMBODIMENTS

Figure 1:
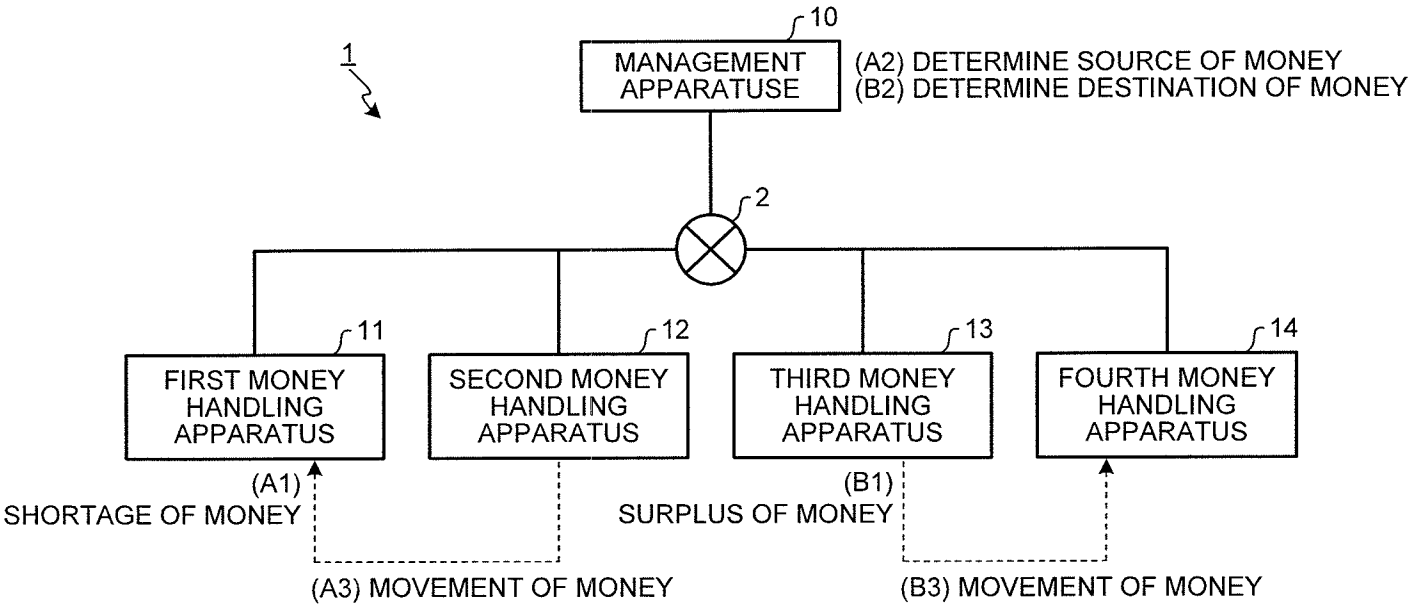
FIG. 1 schematically shows an outline of a money processing system according to an embodiment.

Hereinafter, a money processing system and a money processing method according to the present invention will be described with reference to the accompanying drawings. FIG. 1 schematically shows an outline of a money processing system according to an embodiment. As shown in FIG. 1, the money processing system 1 includes a management apparatus 10 and a plurality of money handling apparatuses 11 to 14. The management apparatus 10 and the money handling apparatuses 11 to 14 are installed in a store. The management apparatus 10 is communicably connected to the money handling apparatuses 11 to 14 via a network 2. The management apparatus 10 determines whether or not movement of money is required between the money handling apparatuses 11 to 14. When movement of money is required, the management apparatus 10 determines a money movement method.

Although a first money handling apparatus 11, a second money handling apparatus 12, a third money handling apparatus 13, and a fourth money handling apparatus 14 are shown in FIG. 1, the number of money handling apparatuses is not limited. The kinds of the money handling apparatuses are also not limited. The money handling apparatuses may be any of a depositing apparatus performing only depositing of money, a dispensing apparatus performing only dispensing of money, and a depositing/dispensing apparatus performing both depositing and dispensing of money. An object to be handled in each apparatus may be banknotes only, coins only, or both banknotes and coins. When "money" is described in this embodiment, this money is not limited to either banknotes or coins, and may be any of "banknotes", "coins", and "both banknotes and coins".

The management apparatus 10 obtains information from each of the money handling apparatuses 11 to 14 via the network 2. The management apparatus 10 manages the inventory amount of money in each of the money handling apparatuses 11 to 14, based on the obtained information. The inventory amount is information for managing denominations of money stored in each apparatus and an amount of money for each denomination. The management apparatus 10 monitors change of the inventory amount of money, and detects shortage or surplus of money.

For example, the management apparatus 10 manages the number of money for each denomination, and detects shortage of money through comparison with a predetermined lower-limit number, while detecting surplus of money through comparison with a predetermined upper-limit number. Specifically, based on the content of money handling performed in each of the money handling apparatuses 11 to 14, the management apparatus 10 manages the number of money for each denomination in the apparatus, and detects shortage of money through comparison with the predetermined lower-limit number, while detecting surplus of money through comparison with the predetermined upper-limit number. Alternatively, for example, the management apparatus 10 manages the weight of money for each denomination in each of the money handling apparatuses 11 to 14, and detects shortage of money through comparison with a predetermined lower-limit weight, while detecting surplus of money through comparison with a predetermined upper-limit weight.

Upon detecting shortage of money, the management apparatus 10 determines a money movement method in order to replenish, with money, a money handling apparatus in which shortage of money occurs. Replenishment with money is a process in which a store clerk takes out money from one or a plurality of money handling apparatuses, moves while carrying the money, and stores the carried money into a money handling apparatus in which shortage of money is detected.

For example, as shown in FIG. 1, when shortage of money occurs in the first money handling apparatus 11 (A1), the management apparatus 10 detects this shortage, and determines a money movement method for replenishing the first money handling apparatus 11 with money. Specifically, the management apparatus 10 determines denomination(s) and the number of money to replenish the first money handling apparatus 11, and selects one or a plurality of money handling apparatuses as sources of the money for the replenishment, from among the other money handling apparatuses 12, 13 and 14 (A2). The management apparatus 10 notifies the store clerk of the determined money movement method. For example, information that guides the store clerk for explaining the money movement method is displayed on a display unit of the management apparatus 10. For example, the information that guides the store clerk for explaining the money movement method is displayed on a mobile terminal held by the store clerk. Upon receiving the notification, the store clerk moves the money according to the money movement method determined by the management apparatus 10 (A3). When the second money handling apparatus 12 is determined as a source of the money, the store clerk replenishes the first money handling apparatus 11 with money taken out from the second money handling apparatus 12, as indicated by a broken line in FIG. 1.

Upon detecting surplus of money, the management apparatus 10 determines a money movement method in order to collect money from a money handling apparatus in which surplus of money occurs, and store the collected money into another money handling apparatus. Collection of money is a process in which a store clerk takes out money from a money handling apparatus in which surplus of money is detected, moves while carrying the money, and stores the carried money into one or a plurality of money handling apparatuses.

For example, as shown in FIG. 1, when surplus of money occurs in the third money handling apparatus 13 (B1), the management apparatus 10 detects this surplus, and determines a money movement method for collecting money from the third money handling apparatus 13. Specifically, the management apparatus 10 determines denomination(s) and the number of money to be collected from the money handling apparatus 13, and selects one or a plurality of money handling apparatuses as destinations of the money for the collection, from among the other money handling apparatuses 11, 12 and 14 (B2). The management apparatus 10 notifies the store clerk of the determined money movement method. As in the case where shortage of money is detected, the display unit of the management apparatus 10 and/or the mobile terminal held by the store clerk is used for notifying of the money movement method. The store clerk moves the money according to the money movement method determined by the management apparatus 10 (B3). When the fourth money handling apparatus 14 is determined as a destination of the collected money, the store clerk stores the money collected from the third money handling apparatus 13 into the fourth money handling apparatus 14, as indicated by a broken line in FIG. 1.

When replenishing a money handling apparatus with money, there are cases where all the money for the replenishment cannot be prepared from a single money handling apparatus. In this case, the management apparatus 10 determines a plurality of money handling apparatuses as sources of the money to prepare all the money. After determining the plurality of apparatuses as sources, the management apparatus 10 determines a movement route so as to minimize the movement distance of the store clerk who moves the money. The management apparatus 10 notifies the store clerk of the money movement route and the content of work the store clerk should perform to the respective apparatuses.

When collecting money from a money handling apparatus, there are cases where all the collected money cannot be stored in a single money handling apparatus. In this case, the management apparatus 10 determines a plurality of money handling apparatuses as destinations of the money to store all the collected money. The management apparatus 10 determines a movement route so as to minimize the movement distance of the store clerk, and notifies the store clerk of the money movement path and the content of work the store clerk should perform to the respective apparatuses.

For example, when many money handling apparatuses are installed in a large store, the management apparatus 10 detects shortage and surplus of money, and determines a money movement method to be performed between a plurality of apparatuses in order to solve the shortage and surplus of money. The store clerk moves as guided by the management apparatus 10 to the places where the respective apparatuses are installed. At each place, the store clerk works as guided by the management apparatus 10. It makes movement of money between the apparatuses easy, and reduces a burden on the store clerk who is in charge of movement of money.

The management apparatus 10 can select a source of money for replenishment and a destination of money for collection, based on the present inventory amounts of the respective money handling apparatuses. For example, the management apparatus 10 determines, as the source of money for replenishment, a money handling apparatus having the largest amount of money of a denomination for which the replenishment is to be performed. For example, the management apparatus 10 determines, as the destination of money for collection, a money handling apparatus having the smallest amount of money of a denomination for which the collection is to be performed.

The management apparatus 10 can select a source of money for replenishment and a destination of money for collection, based on the histories of past money handling performed in the respective money handling apparatuses. That is, the management apparatus 10 can determine a money movement method, based on changes in the past inventory amounts in the respective apparatuses. For example, when selecting a source of money for replenishment, the management apparatus 10 determines, as the source of money, an apparatus having the largest increase of money or the smallest decrease of money, on the day, of a denomination for which the replenishment is to be performed. The management apparatus 10 determines the largest increase and the smallest decrease based on the changes in the inventory amounts of the respective money handling apparatuses on the day. For example, when selecting a destination of money for collection, the management apparatus 10 determines, as the destination of money, an apparatus having the smallest increase of money or the largest decrease of money, on the day, of a denomination for which collection is to be performed. The management apparatus 10 determines the smallest increase and the largest decrease based on the changes in the inventory amounts of the respective money handling apparatuses on the day.

The management apparatus 10 can select a source of money for replenishment and a destination of money for collection, based on predetermined priority levels of the respective money handling apparatuses. The priority levels are set by a manager in charge of the money processing system 1, for example. The manager can set a priority level of each money handling apparatus for respective money handling apparatuses. For example, the highest priority level is set to the second money handling apparatus 12 for a case where the first money handling apparatus 11 is to be replenished with money, while the highest priority level is set to the third money handling apparatus 13 for a case where the fourth money handling apparatus 14 is to be replenished with money. The manager can change the priority levels between selecting a source of money and selecting a destination of money. For example, the highest priority level is set to the second money handling apparatus 12 when selecting a source of money to replenish the first money handling apparatus 11, while the highest priority level is set to the third money handling apparatus 13 when selecting a destination of money collected from the first money handling apparatus 11.

The management apparatus 10 can select a source of money for replenishment and a destination of money for collection, from among money handling apparatuses that have previously been set as options. The manager sets money handling apparatuses to be the options (candidates) for movement of money, and/or money handling apparatuses to be excluded from the options. The manager can set an apparatus to be an option, which is a candidate when selecting an apparatus, for each money handling apparatus. The manager can change the options so that the apparatuses to be options when selecting a source of money are different from the apparatuses to be options when selecting a destination of money. For example, the manager excludes the third money handling apparatus 13 from the options when selecting a source of money to replenish the first money handling apparatus 11, and excludes the fourth money handling apparatus 14 from the options when selecting a destination of money collected from the first money handling apparatus 11.

The management apparatus 10 selects a source of money for replenishment and a destination of money for collection, based on at least one condition among the present inventory amount, change in the past inventory amount, setting of priority levels, and setting of options. The manager in charge of the money processing system 1 can change the apparatus selection method by the management apparatus 10 by setting the condition. When selecting a money handling apparatus based on the setting, if a plurality of apparatuses become candidates for a money movement method, the management apparatus 10 selects an apparatus so as to minimize the movement distance along which money is moved. The management apparatus 10 can determine the money movement method so as to move money between one or a plurality of money handling apparatuses as sources and one or a plurality of money handling apparatuses as destinations.

The money processing system 1 will be described using specific money handling apparatuses used in a store. Although the kinds of the money handling apparatuses included in the money processing system 1 are not particularly limited, a money changer, a change dispenser, and a money recycler (money depositing/dispensing apparatus) will be described as examples below.

Figure 2:
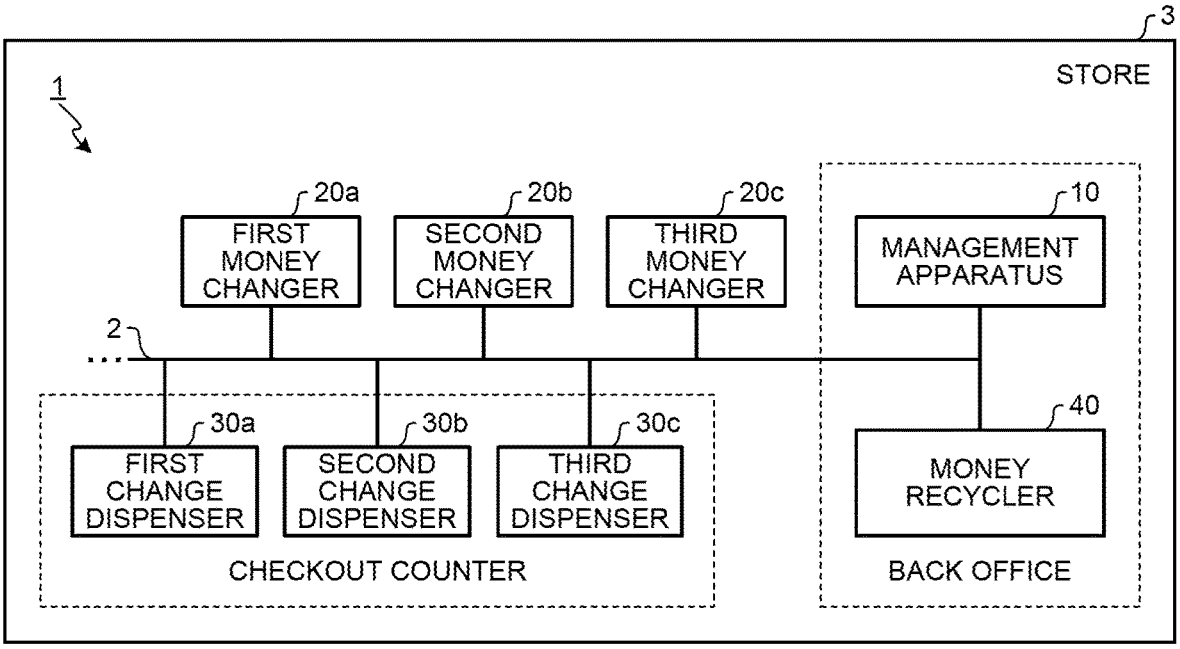
FIG. 2 schematically shows a configuration of a money processing system installed in a store.

FIG. 2 schematically shows the configuration of the money processing system 1 installed in a store 3. The money processing system 1 includes the management apparatus 10, a plurality of money changers 20 (20*a* to 20*c*), a plurality of change dispensers 30 (30*a* to 30*c*), and a money recycler 40. The management apparatus 10 is communicably connected to the money changers 20, the change dispensers 30, and the money recycler 40 via the network 2.

The management apparatus 10 and the money recycler 40 are installed in a back office of the store 3. The three change dispensers 30 are installed at a checkout counter where a checkout process of commodities a customer purchases is performed. A plurality of POS registers are installed at the checkout counter. One change dispenser 30 is connected to one POS register. The places where the three money changers 20 are installed are not particularly limited. For example, one money changer 20*a* is installed near the entrance of the store 3 while other two money changers 20*b* and 20*c* are respectively installed in separate places away from the entrance.

Figure 3:
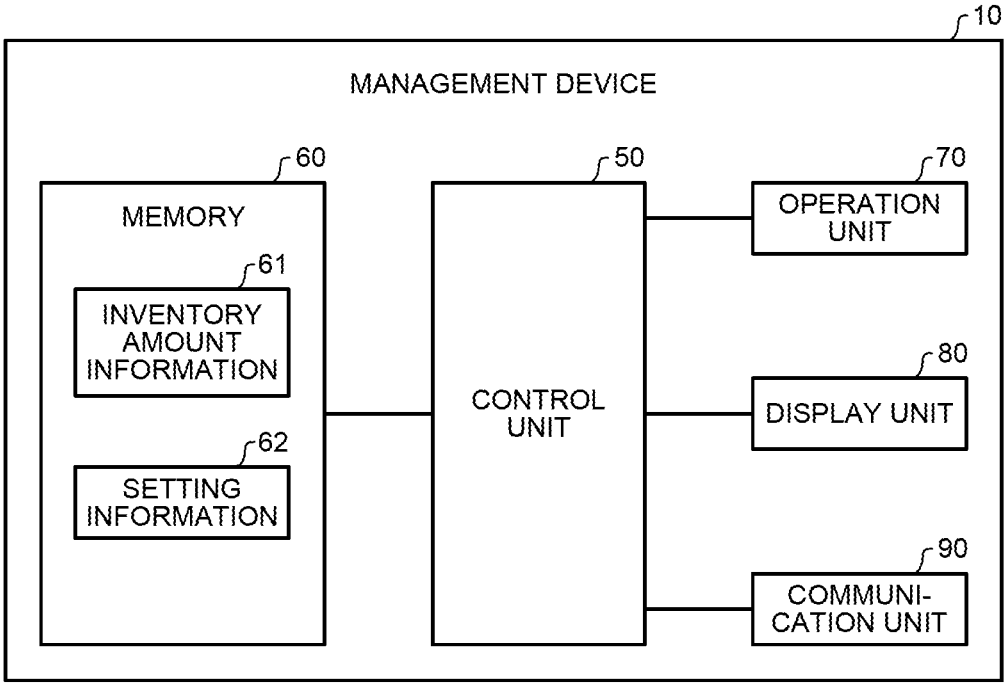
FIG. 3 is a block diagram showing a configuration of a management apparatus.

FIG. 3 is a block diagram showing the configuration of the management apparatus 10. The management apparatus 10 is implemented by a computer device including a control unit 50, a memory 60, an operation unit 70, a display unit 80, and a communication unit 90. The operation unit 70 is used for inputting information regarding setting and operation of the money processing system 1. The display unit 80 is used for displaying information regarding setting and operation of the money processing system 1. The communication unit 90 exchanges information with the money changer 20, the change dispenser 30, and the money recycler 40 via the network 2.

The memory 60 is a nonvolatile storage device. In the memory 60, inventory amount information 61 and setting information 62 are stored. The inventory amount information 61 includes information of the inventory amounts of each money changer 20, each change dispenser 30, and the money recycler 40. Specifically, the inventory amount information 61 includes the present inventory amounts and the past inventory amounts of the respective apparatuses 20, 30 and 40. The setting information 62 includes information used by the management apparatus 10 to determine a money movement method. Specifically, the setting information 62 includes conditions for detecting shortage of money and surplus of money, conditions for selecting a source of money and a destination of money, and information for determining a movement route for a store clerk when he/she moves money. The control unit 50 controls the respective components while referring to the various kinds of information stored in the memory 60, thereby realizing the functions and operations of the management apparatus 10 described below.

Figure 4:
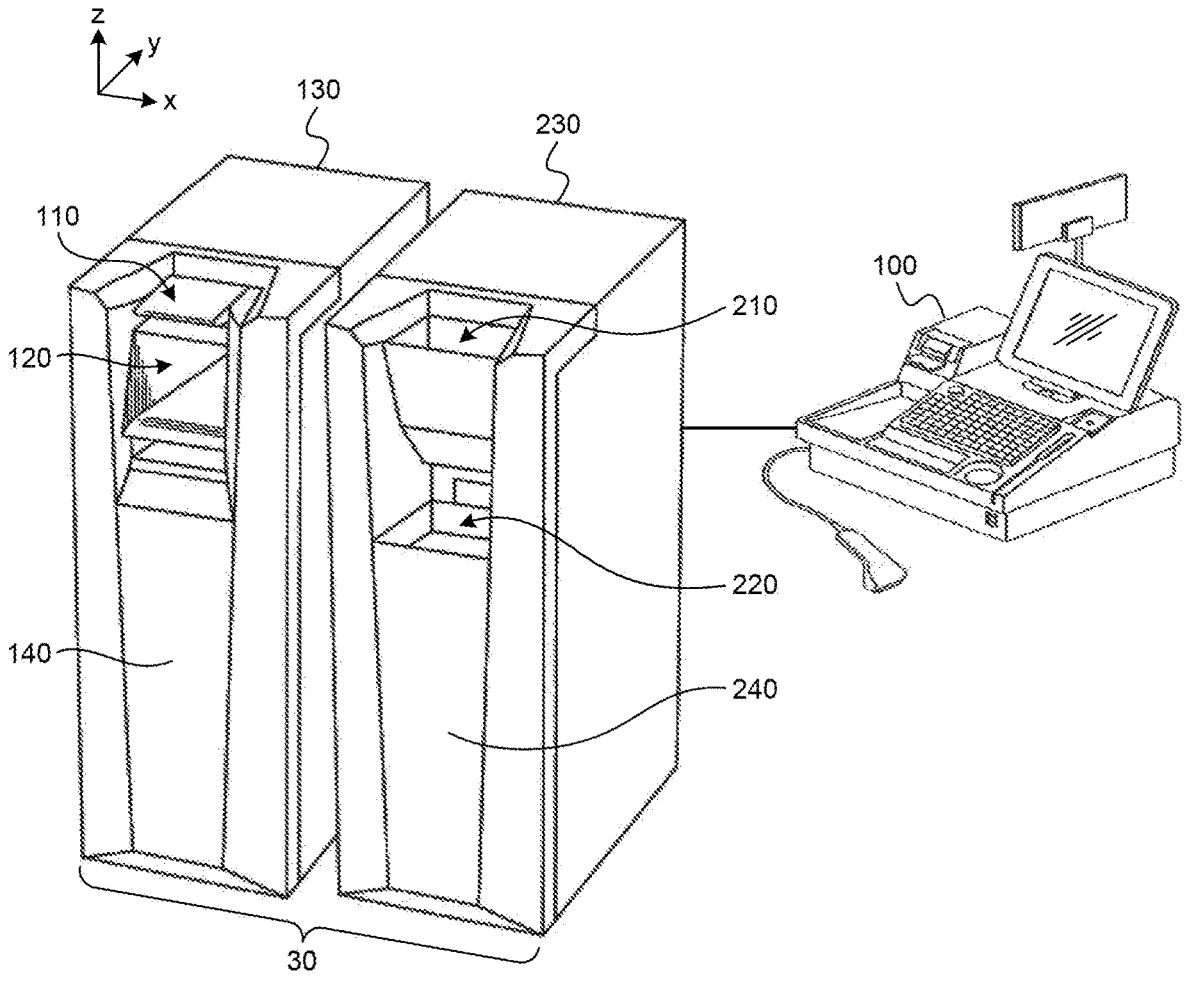
FIG. 4 shows outer appearances of a change dispenser and a POS register.

The change dispenser 30 will be described with reference to FIG. 4 and FIGS. 5A and 5B. FIG. 4 shows the outer appearances of the change dispenser 30 and the POS register 100. The change dispenser 30 includes a banknote handling unit 130 and a coin handling unit 230. The banknote handling unit 130 includes an inlet 110 from which banknotes are deposited, and an outlet 120 from which banknotes are dispensed. The banknote handling unit 130 has a cover 140 at a front surface thereof. With the cover 140 being opened, a cassette 170 (see FIG. 5A) is mounted and dismounted. The coin handling unit 230 includes an inlet 210 from which coins are deposited, and an outlet 220 from which coins are dispensed. The coin handling unit 230 has a cover 240 at a front surface thereof. With the cover 240 being opened, a cassette 270 (see FIG. 5B) is mounted and dismounted.

The POS register 100 and the change dispenser 30 are communicably connected to each other. In the checkout process, the change dispenser 30 executes depositing of money inserted by a customer to pay for commodities, so that the inserted money is recognized and counted and a total amount of the inserted money is sent to the POS register 100. The POS register 100 calculates a total amount of prices of the commodities the customer purchases, compares the total amount of prices with the amount of deposited money received from the change dispenser 30, and instructs the change dispenser 30 to dispense change, according to need. Upon receiving the instruction, the change dispenser 30 executes dispensing of change.

Figure 5B:
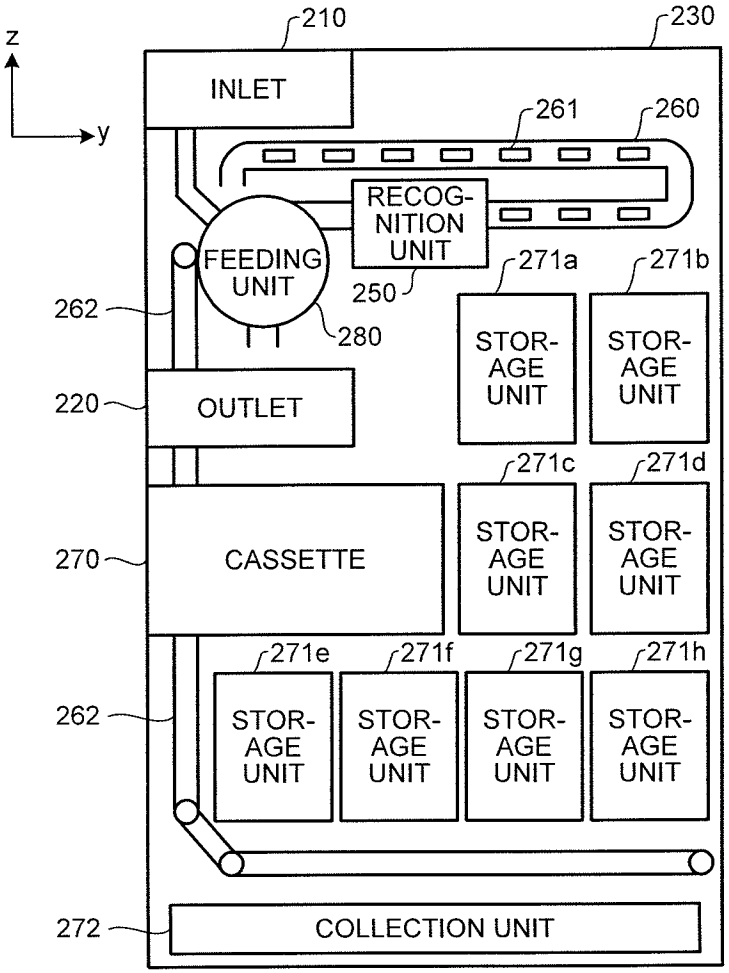
FIG. 5B schematically shows an internal configuration of a coin handling unit.
Figure 5A:
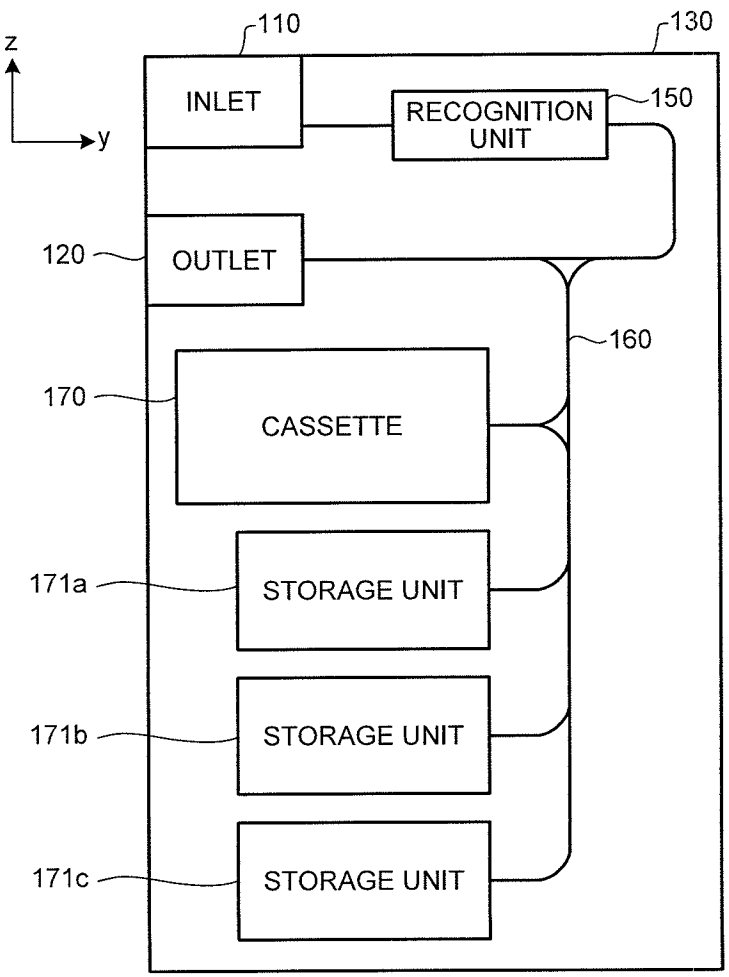
FIG. 5A schematically shows an internal configuration of a banknote handling unit.

FIG. 5A and FIG. 5B schematically show the internal configurations of the banknote handling unit 130 and the coin handling unit 230, respectively. Of the money that the customer has paid in the checkout process, banknotes are deposited in the banknote handling unit 130 while coins are deposited in the coin handling unit 230. Of the change to be returned to the customer in the checkout process, banknotes are dispensed from the banknote handling unit 130 while coins are dispensed from the coin handling unit 230.

The banknote handling unit 130 shown in FIG. 5A performs depositing and dispensing of banknotes. In the dispensing process, banknotes are one by one fed out from storage units 171 (171*a* to 171*c*). The fed out banknotes are transported along a transport path by a transport unit 160 and are discharged from the outlet 120. Denominations of banknotes to be stored in the respective storage units 171*a* to 171*c* are set in advance. The change dispenser 30 manages the denomination and the number of banknotes stored in each of the storage units 171*a* to 171*c*. This allows the change dispenser 30 to dispense a required number of banknotes for each required denomination from the outlet 120 in the dispensing process.

In the depositing process, banknotes received from the inlet 110 are one by one fed out into the banknote handling unit 130. The fed out banknotes are transported along the transport path by the transport unit 160. A recognition unit 150 recognizes and counts the transported banknotes. The recognition unit 150 recognizes, for example, denomination, authenticity, and fitness of each banknote. Based on the recognition result, banknotes that cannot be deposited are returned as reject notes from the outlet 120, while banknotes that can be deposited are stored in the storage units 171*a* to 171*c* for each denomination.

Replenishment of the change dispenser 30 with banknotes and collection of banknotes from the change dispenser 30 can be performed using the cassette 170. The cassette 170 is mountable and dismountable with respect to the banknote handling unit 130. When collecting banknotes from the change dispenser 30, banknotes to be collected are fed out from the storage unit 171 and stored in the cassette 170. The store clerk dismounts the cassette 170, in which the banknotes have been stored, from the banknote handling unit 130 to collect the banknotes. When replenishing the change dispenser 30 with banknotes, the store clerk mounts the cassette 170, in which banknotes for replenishment are being stored, to the banknote handling unit 130. Then, the banknotes fed out from the cassette 170 are recognized by the recognition unit 150, and are stored in any of the storage units 171*a* to 171*c* according to the denominations thereof.

Replenishment and collection of banknotes can be performed using the inlet 110 and the outlet 120. Specifically, the store clerk collects banknotes fed out from the storage unit 171 and discharged to the outlet 120, thereby the banknotes are collected from the banknote handling unit 130. The store clerk puts banknotes to the inlet 110, and the banknotes are recognized by the recognition unit 150 and stored in any of the storage units 171*a* to 171*c* according to the recognized denominations, thereby the banknote handling unit 130 is replenished with the banknotes.

A process of storing banknotes collected from another apparatus into the change dispenser 30 is performed in a similar manner to the process of replenishing the change dispenser 30 with banknotes. A process of taking out, from the change dispenser 30, banknotes to replenish another apparatus is performed in a similar manner to the process of collecting banknotes from the change dispenser 30.

When the change dispenser 30 is replenished with banknotes moved from another apparatus by using the cassette 170, banknotes other than those for replenishment may be mixed in the banknotes in the cassette 170. Likewise, when the store clerk replenishes the change dispenser 30 with banknotes through the inlet 110, banknotes other than those for replenishment may be mixed in the banknotes in the inlet 110. In this case, the banknotes for replenishment are stored in the storage unit 171 while other banknotes are discharged to the outlet 120.

Also, when banknotes collected from another apparatus by using the cassette 170 are stored in the change dispenser 30, banknotes other than those to be stored may be mixed in the banknotes in the cassette 170. When banknotes collected from another apparatus by the store clerk are stored into the change dispenser 30 through the inlet 110, banknotes other than those to be stored may be mixed in the banknotes in the inlet 110. In this case, only the banknotes to be stored are stored into the storage unit 171 while other banknotes are discharged to the outlet 120.

When determining a money movement method, the management apparatus 10 determines whether or not there are banknotes to be discharged from the change dispenser 30 set as a destination of the movement. If there are banknotes to be discharged at the destination, the management apparatus 10 determines a money movement method including a handling method for the discharged banknotes. For example, the management apparatus 10 determines that, when banknotes are moved to the first change dispenser 30*a* and some of the banknotes are to be discharged from the outlet 120 of the first change dispenser 30*a*, the discharged banknotes should be stored into the second change dispenser 30*b* from the inlet 110 of the second change dispenser 30*b*. For another example, the management apparatus 10 determines that the discharged banknotes in the outlet 120 should be put in the inlet 110 of the first change dispenser 30*a* and transported and stored in the cassette 170 mounted to the first change dispenser 30*a*, and the stored banknotes should be fed out from the cassette 170, which has been removed from the first change dispenser 30*a* and mounted to the second change dispenser 30*b*, and stored in the second change dispenser 30*b*.

The coin handling unit 230 shown in FIG. 5B performs depositing and dispensing of coins. In the dispensing process, coins are one by one fed out from the storage units 271 (271*a* to 271*h*). A dispensing transport unit 262 disposed beneath the storage units 271 receives the coins fed out from the storage units 271, and transports the received coins upward to a feeding unit 280. When the feeding unit 280 opens a bottom portion thereof, the coins in the feeding unit 280 are discharged into the outlet 220. Denominations of coins to be stored in the respective storage units 271*a* to 271*h* are set in advance. The change dispenser 30 manages the denomination and the number of coins stored in each of the storage units 271*a* to 271*h*. This allows the change dispenser 30 to dispense a required number of coins for each required denomination from the outlet 220.

In the depositing process, coins received from the inlet 210 are dropped into the feeding unit 280 inside the coin handling unit 230, and are one by one fed out from the feeding unit 280. The fed out coins are transported along a transport path by a depositing transport unit 260. A recognition unit 250 recognizes and counts the transported coins. The recognition unit 250 recognizes, for example, denomination, authenticity, and fitness of each coin. The transport path located downstream of the recognition unit 250 is provided with a plurality of chutes 261. Each chute 261 is connected to any one of the outlet 220, a cassette 270, the storage units 271*a* to 271*h*, and a collection unit 272. The chutes 261 are usually closed. When a chute 261 is opened based on the recognition result of a coin, the coin is dropped into the chute 261 and then stored in any of the outlet 220, the cassette 270, the storage units 271*a* to 271*h*, and the collection unit 272. Coins that cannot be deposited are not dropped from the chutes 261 but are continued to be transported and are returned as reject coins from the outlet 220. Coins that can be deposited are stored into the storage units 271*a* to 271*h* for each denomination. The collection unit 272 is used for storing coins that cannot be stored in the storage units 271 because the storage units 271 are full of coins, for example. The feeding unit 280 and the storage units 271 each have a rotary disk that rotates in a inclined state. A plurality of projecting members are disposed on an outer area of the upper surface of the rotary disk. The projecting members catch and feed out coins one by one.

Replenishment of the change dispenser 30 with coins and collection of coins from the change dispenser 30 can be performed using the cassette 270. The cassette 270 is mountable and dismountable with respect to the coin handling unit 230. When collecting coins from the change dispenser 30, coins to be collected are fed out from the storage unit 271. The dispensing transport unit 262 receives the coins fed out from the storage unit 271, transports the coins upward and stores the coins in the cassette 270. The store clerk dismounts the cassette 270 in which the coins have been stored, to collect the coins. When replenishing the change dispenser 30 with coins, the store clerk mounts the cassette 270, in which coins for replenishment are being stored, to the coin handling unit 230. Then, coins fed out from the cassette 270 are transported to the feeding unit 280 by the dispensing transport unit 262. Then, coins are fed out from the feeding unit 280, recognized by the recognition unit 250, and stored in any of the storage units 271*a* to 271*h* according to the denominations thereof.

Replenishment and collection of coins can be performed using the inlet 210 and the outlet 220. Specifically, the store clerk collects coins fed out from the storage unit 271 and discharged to the outlet 220, thereby the coins are collected from the coin handling unit 230. The store clerk puts coins to the inlet 210, and the coins are recognized by the recognition unit 250 and stored in any of the storage units 171*a* to 171*c* according to the recognized denominations, thereby the coin handling unit 230 is replenished with the coins.

A process of storing coins collected from another apparatus into the change dispenser 30 is performed in a similar manner to the process of replenishing the change dispenser 30 with coins. A process of taking out, from the change dispenser 30, coins to replenish another apparatus is performed in a similar manner to the process of collecting coins from the change dispenser 30.

When performing the process of replenishing with coins or the process of storing collected coins, some coins may be discharged to the outlet 220 as in the processes for banknotes. When determining a money movement method, if the management apparatus 10 recognizes that some coins will be discharged in the destination change dispenser 30, the management apparatus 10 determines a money movement method including a method for handling the discharged coins. For example, the management apparatus 10 determines that, when coins are moved to the first change dispenser 30*a* and some of the coins are to be discharged from the outlet 220 of the first change dispenser 30*a*, the discharged coins should be stored into the second change dispenser 30*b* from the inlet 210 of the second change dispenser 30*b*. For another example, the management apparatus 10 determines that the discharged coins in the outlet 220 should be put in the inlet 210 of the first change dispenser 30*a* and transported and stored in the cassette 270 mounted to the first change dispenser 30*a*, and the stored coins should be fed out from the cassette 270, which has been removed from the first change dispenser 30*a* and mounted to the second change dispenser 30*b*, and stored in the second change dispenser 30*b*.

Figure 6:
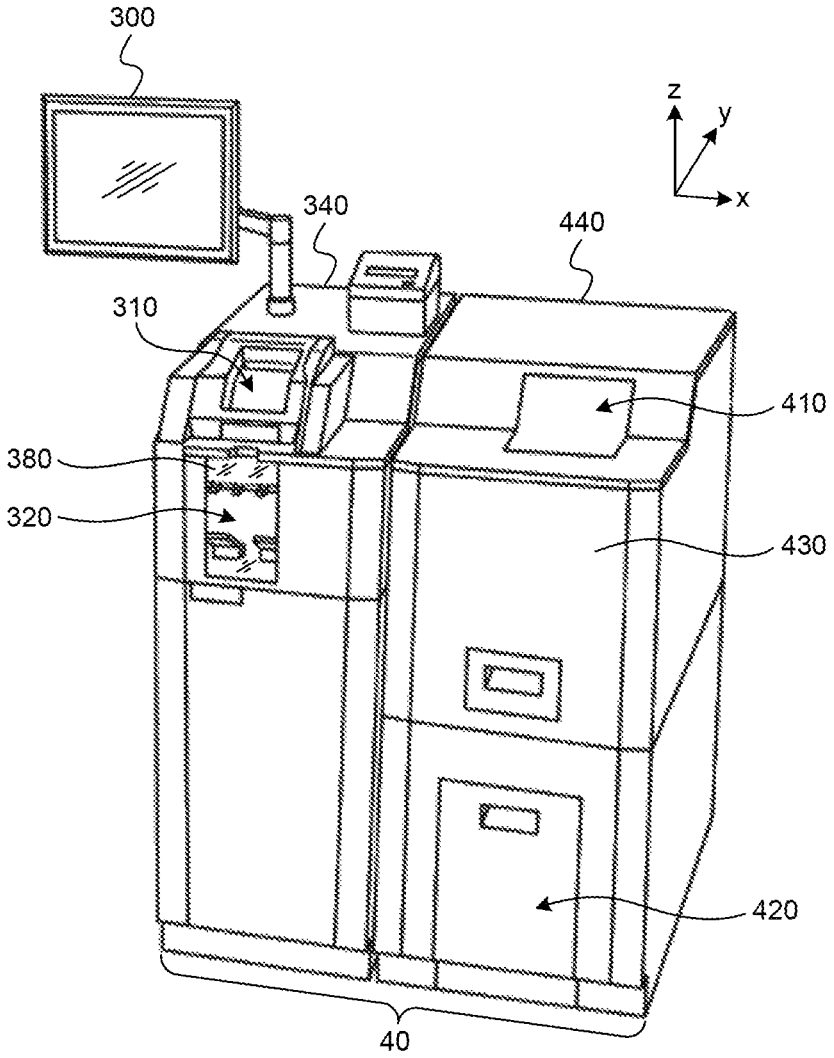
FIG. 6 shows an outer appearance of a money recycler.

The money recycler 40 will be described with reference to FIG. 6 to FIG. 8. FIG. 6 shows the outer appearance of the money recycler 40. The money recycler 40 performs depositing and dispensing of money. The money recycler 40 includes a banknote handling unit 340 and a coin handling unit 440. A terminal device 300 is disposed on an upper surface of the banknote handling unit 340. The terminal device 300 is implemented by a computer device including a touch panel type liquid crystal display unit. A store clerk operates the terminal device 300 to perform depositing and dispensing by using the money recycler 40.

The banknote handling unit 340 includes a depositing unit 310 from which banknotes are deposited, a reject port 380 for returning reject banknotes included in deposited banknotes, and an outlet 320 from which banknotes are dispensed. The coin handling unit 440 includes an inlet 410 from which coins are deposited, and a dispensing unit 420 from which coins are dispensed. The coin handling unit 440 has a cover 430 at a front surface thereof. With the cover 430 being opened, a reject unit 472 (see FIG. 8) is drawn frontward.

Figure 7:
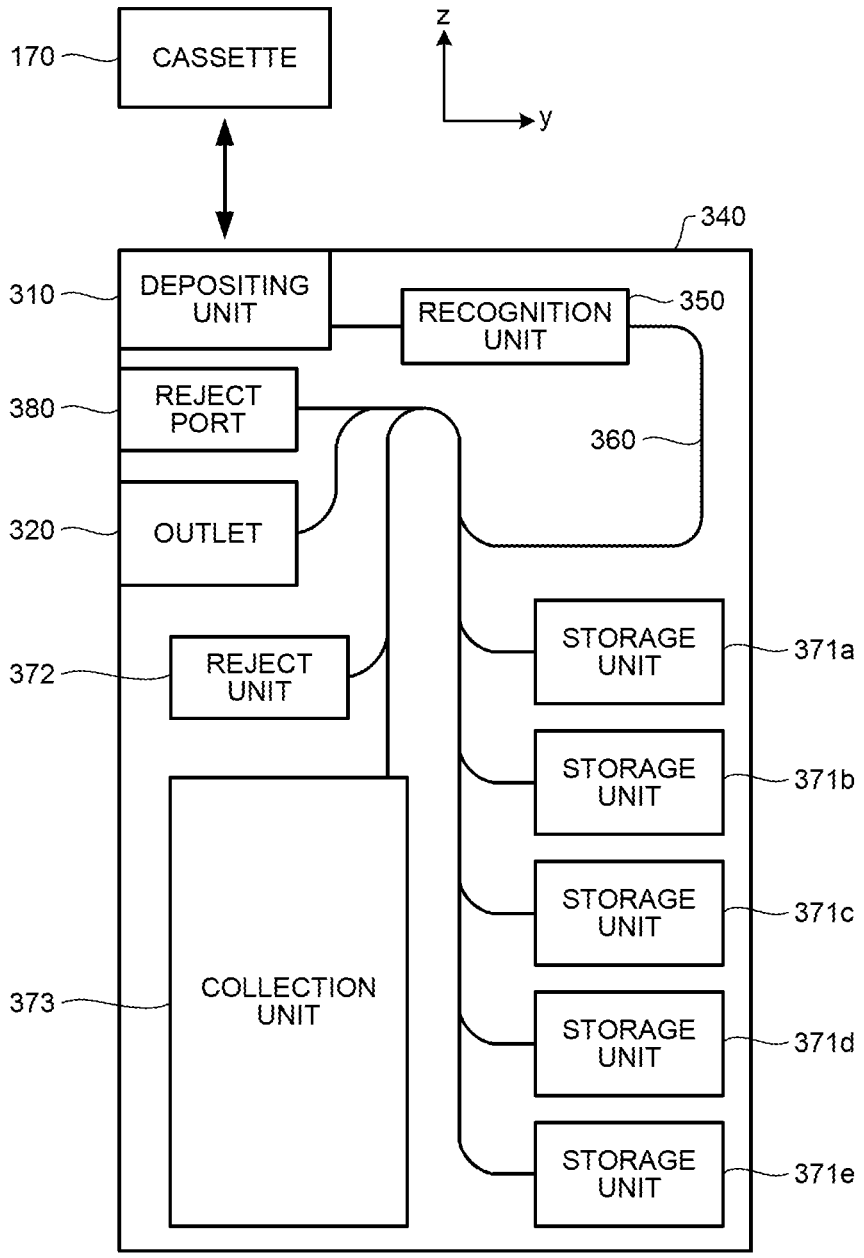
FIG. 7 schematically shows an internal configuration of a banknote handling unit.

FIG. 7 schematically shows the internal configuration of the banknote handling unit 340. The banknote handling unit 340 performs depositing and dispensing of banknotes. In the dispensing process, banknotes are one by one fed out from the storage units 371 (371*a* to 371*e*), are transported along a transport path by a transport unit 360, and are discharged to the outlet 320. Denominations of banknotes to be stored in the respective storage units 371*a* to 371*e* are set in advance. The money recycler 40 manages the denomination and the number of banknotes stored in each of the storage units 371*a* to 371*e*. This allows the money recycler 40 to dispense a required number of banknotes for each required denomination from the outlet 320.

In the depositing process, banknotes received from an inlet of the depositing unit 310 are one by one fed out into the banknote handling unit 340. The fed out banknotes are transported along the transport path by the transport unit 360. A recognition unit 350 recognizes and counts the transported banknotes. The recognition unit 350 recognizes, for example, denomination, authenticity, and fitness of each banknote. Based on the recognition result, banknotes that cannot be deposited are returned as reject notes from the reject port 380, while banknotes that can be deposited are stored into the storage units 371*a* to 371*e* for each denomination.

Replenishment of the money recycler 40 with banknotes and collection of banknotes from the money recycler 40 can be performed using the cassette 170. The depositing unit 310 is mountable and dismountable with respect to the banknote handling unit 340. The cassette 170 used in the banknote handling unit 130 of the change dispenser 30 is mountable and dismountable with respect to a mount portion from which the depositing unit 310 has been dismounted. When collecting banknotes from the money recycler 40, the store clerk dismounts the depositing unit 310 from the banknote handling unit 340, and mounts the cassette 170 instead. Banknotes to be collected are fed out from the storage unit 371 and stored in the cassette 170. The store clerk dismounts the cassette 170, in which the banknotes have been stored, from the banknote handling unit 340 to collect the banknotes. When replenishing the money recycler 40 with banknotes, the store clerk dismounts the depositing unit 310 from the banknote handling unit 340, and mounts the cassette 170 in which banknotes for replenishment are being stored. Then, banknotes fed out from the cassette 170 are recognized by the recognition unit 350, and are stored in any of the storage units 371*a* to 371*e* according to the denominations thereof.

Replenishment and collection of banknotes can be performed using the depositing unit 310 and the outlet 320. Specifically, the store clerk collects banknotes fed out from the storage unit 371 and discharged to the outlet 320, thereby the banknotes are collected from the banknote handling apparatus 340. The store clerk puts banknotes to the depositing unit 310, and the banknotes are recognized by the recognition unit 350 and stored in any of the storage units 371*a* to 371*e* according to the recognized denominations, thereby the banknote handling unit 340 is replenished with the banknotes.

A process of storing banknotes collected from another apparatus into the money recycler 40 is performed in a similar manner to the process of replenishing the money recycler 40 with banknotes. A process of taking out, from the money recycler 40, banknotes to replenish another apparatus is performed in a similar manner to the process of collecting banknotes from the money recycler 40.

Figure 8B:
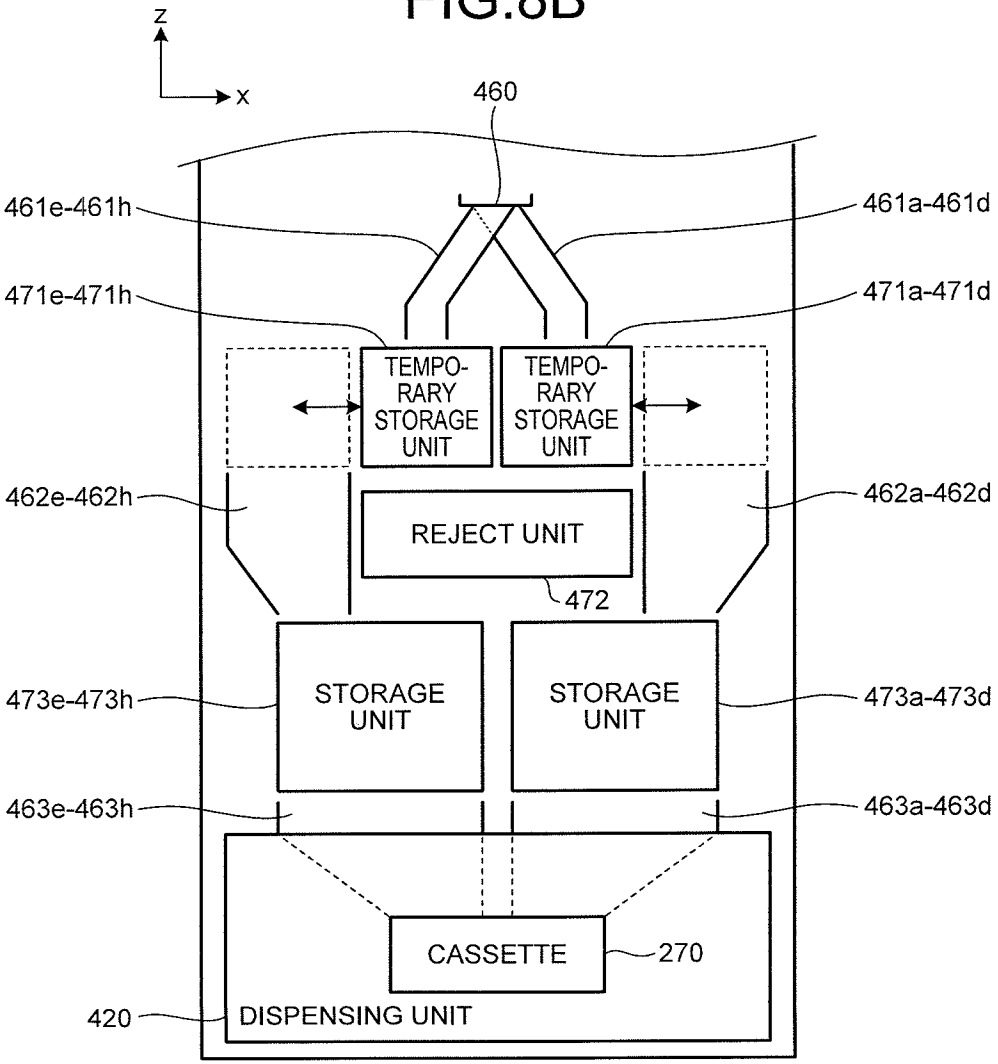
FIG. 8B schematically shows the internal configuration of the coin handling unit.
Figure 8A:
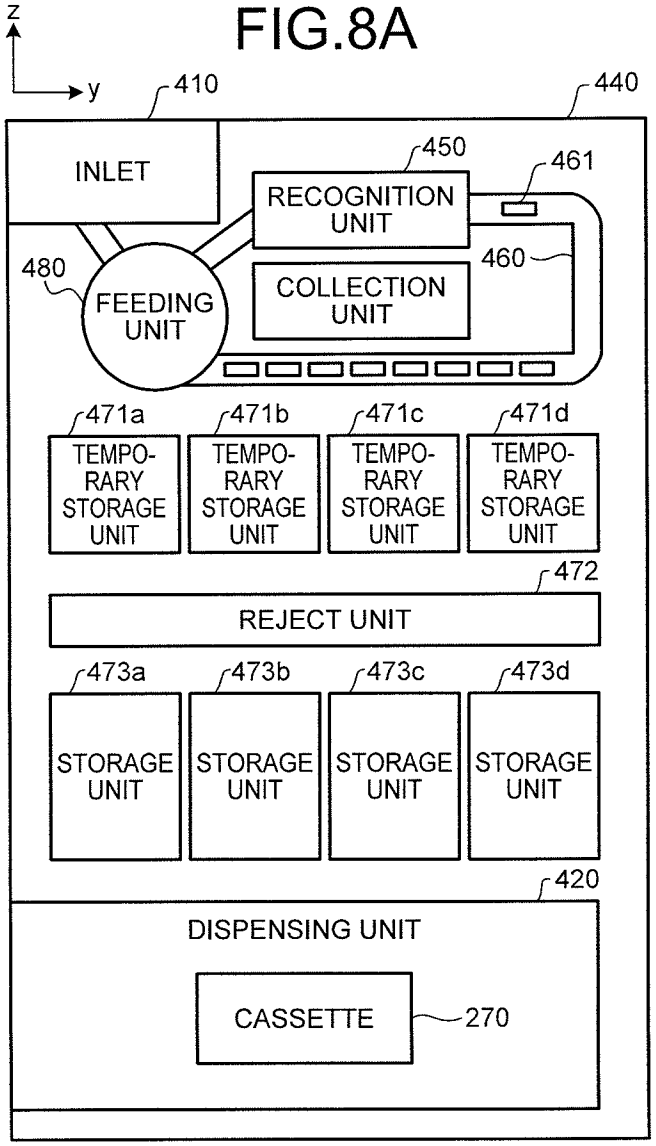
FIG. 8A schematically shows an internal configuration of a coin handling unit.

FIGS. 8A and 8B schematically show the internal configuration of the coin handling unit 440. The coin handling unit 440 performs depositing and dispensing of coins. FIG. 8A shows the coin handling unit 440 as viewed from the right side of the money recycler 40 (from the side in the X axis positive direction). FIG. 8B shows a lower portion of the coin handling unit 440 as viewed from the front side.

In the depositing process, coins received from the inlet 410 shown in FIG. 8A are dropped into a feeding unit 480 inside the coin handling unit 440, and are one by one fed out from the feeding unit 480. The fed out coins are transported along the transport path by a transport unit 460. A recognition unit 450 recognizes and counts the transported coins. The recognition unit 450 recognizes, for example, denomination, authenticity, and fitness of each coin. The transport path located downstream of the recognition unit 450 is provided with a plurality of chutes 461. Each chute 461 is connected to any one of the reject unit 472 and temporary storage units 471 (471*a* to 471*h*). The chutes 461 are usually closed. When a chute 461 is opened based on the recognition result of a coin, the coin is dropped into the chute 461 and then stored in any of the reject unit 472 and the temporary storage units 471*a* to 471*h*. Coins that cannot be deposited are stored in the reject unit 472 as reject coins. Coins that can be deposited are stored in the temporary storage unit 471 for each denomination. The feeding unit 480 and storage units 473 each have a rotary disk that rotates in a inclined state. A plurality of projecting members are disposed on an outer area of the upper surface of the rotary disk. The projecting members catch and feed out coins one by one.

The coin handling unit 440 includes eight temporary storage units 471*a* to 471*h*, and eight storage units 473*a* to 473*h* corresponding to the respective temporary storage units 471*a* to 471*h*. Four storage units 473*a* to 473*d* and four storage units 473*e* to 473*h* are disposed separately in the left-right direction (X-axis direction) of the coin handling unit 440. The four storage units in each of separated two lines are aligned in the front-rear direction (Y-axis direction) of the coin handling unit 440. The temporary storage units 471*a* to 471*h* are disposed above and corresponding to the respective storage units 473*a* to 473*h*. The transport unit 460 has eight chutes 461 (461*a* to 461*h*) corresponding to the respective temporary storage units 471*a* to 471*h*.

The reject unit 472 is disposed beneath the temporary storage units 471. When the bottom surface of a temporary storage unit 471 is opened in the state shown in FIG. 8B, dropped coins are stored into the reject unit 472. The reject unit 472 is disposed so as to receive the coins dropped from all the temporary storage units 471*a* to 471*h*. The coins in the reject unit 472 can be taken out from the coin handling unit 440 by drawing the reject unit 472 frontward with the cover 430 shown in FIG. 6 being opened.

The temporary storage units 471*a* to 471*h* are movable in the left-right direction as shown by an arrow in FIG. 8B. Eight chutes 462 (462*a* to 462*h*) connecting with the storage units 473*a* to 473*h* are disposed at positions to which the temporary storage units 471*a* to 471*h* move outward in the left-right direction of the coin handling unit 440, i.e., at positions indicated by broken lines in FIG. 8B. When the bottom surface of a temporary storage unit 471 is opened at the position indicated by the broken line, dropped coins are stored into a storage unit 473 through a chute 462. Thus, coins in the temporary storage units 471*a* to 471*h* are stored into the corresponding storage units 473*a* to 473*h*.

The dispensing unit 420 can be drawn out from the front side of the coin handling unit 440. The cassette 270 used in the coin handling unit 230 of the change dispenser 30 can be mounted and dismounted with respect to the drawn dispensing unit 420. In the dispensing process, coins are one by one fed out from the storage units 473, and are stored in the cassette 270 mounted to the dispensing unit 420, through the chutes 463*a* to 463*h* corresponding to the storage units 473*a* to 473*h*. Denominations of coins to be stored in the respective storage units 473*a* to 473*h* are set in advance. The money recycler 40 manages the denomination and the number of coins stored in each of the storage units 473*a* to 473*h*. This allows the money recycler 40 to dispense, in the cassette 270, a required number of coins for each required denomination. The store clerk draws out the dispensing unit 420 from the coin handling unit 440, and removes the cassette 270 in which coins has been stored. Thus, the cassette 270 can be used for replenishing the change dispenser 30 with coins.

Collection of coins from the money recycler 40 is performed by storing coins in the cassette 270 of the dispensing unit 420. The store clerk collects coins fed out from the storage units 473 and stored in the cassette 270 through the chutes 463, thereby the coins are collected from the money recycler 40.

Replenishment of the money recycler 40 with coins is performed using the inlet 210. The store clerk puts coins in the inlet 410, and the coins are recognized by the recognition unit 450 and stored in any of the storage units 473*a* to 473*h* according to the recognized denominations, thereby the money recycler 40 is replenished with the coins.

A process of storing coins collected from another apparatus into the money recycler 40 is performed in a similar manner to the process of replenishing the money recycler 40 with coins. A process of taking out, from the money recycler 40, coins to replenish another apparatus is performed in a similar manner to the process of collecting coins from the money recycler 40.

The money changer 20 will be described with reference to FIG. 9 and FIGS. 10A and 10B. A depositing/dispensing apparatus, which receives deposited money and dispenses an equal amount of money in a denomination different from that of the deposited money, can be used as the money changer 20. Hereinafter, a case where the money changer 20 is a depositing apparatus that performs only depositing will be described. Although money to be changed is not particularly limited, a case where the money changer 20 receives only deposited coins will be described.

The money changer 20 receives coins from a customer who wants to change the coins to a banknote, for example, and executes depositing of the received coins. The money changer 20 uses a printer (not shown) to print, on a receipt, a result of recognition and counting of the coins obtained through the depositing process. The customer takes the receipt issued by the money changer 20 and goes to a service counter in the store 3 to receive the banknote.

Figure 9:
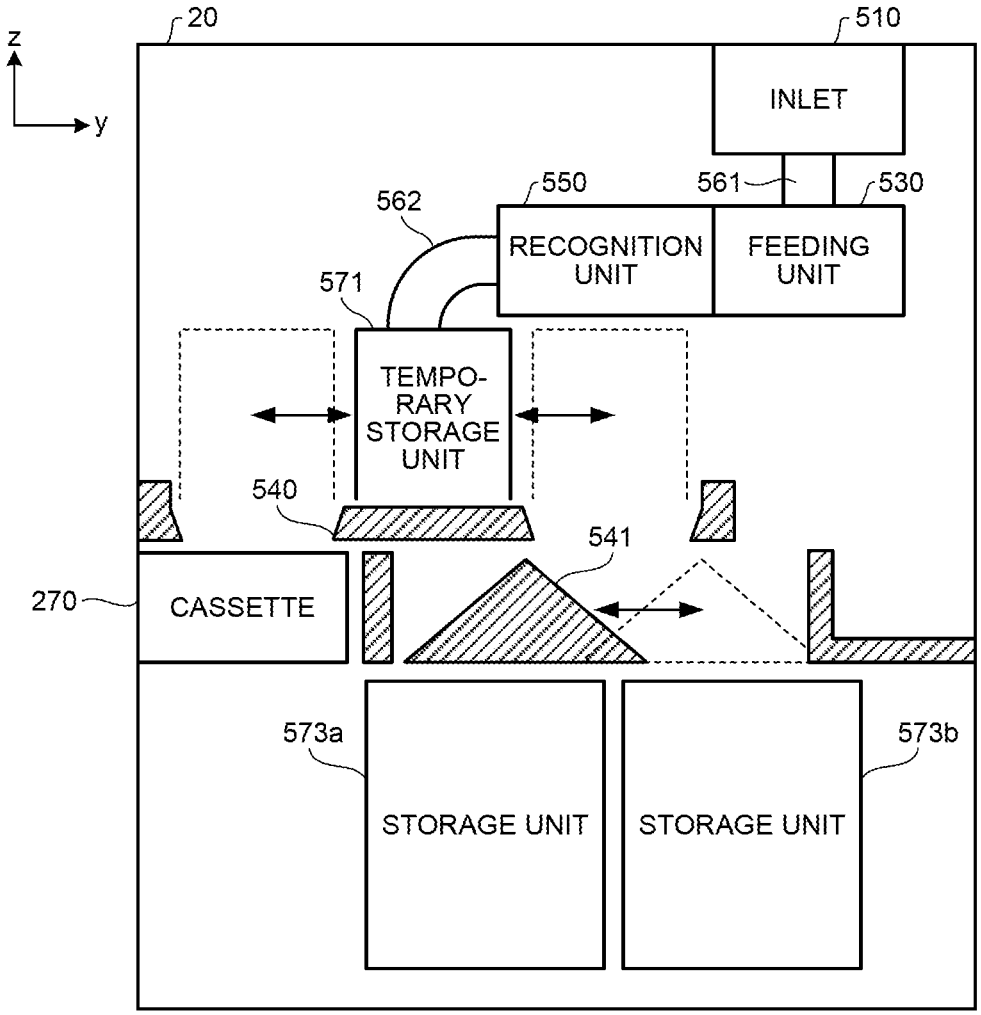
FIG. 9 schematically shows an internal configuration of a money changer.

FIG. 9 schematically shows the internal configuration of the money changer 20. The money changer 20 receives coins from an inlet 510. The coins put in the inlet 510 are dropped into a feeding unit 530. The feeding unit 530 feeds out the coins one by one to a recognition unit 550. The recognition unit 550 recognizes and counts the received coins. The recognition unit 550 recognizes, for example, denomination, authenticity, and fitness of each coin. The recognized coins are stored in a temporary storage unit 571 through a chute 562. The temporary storage unit 571 is movable in the frontward direction (Y-axis negative direction) and the rearward direction (Y-axis positive direction) of the money changer 20 as shown by arrows in FIG. 9. The bottom surface of the temporary storage unit 571 is opened.

When the temporary storage unit 571 moves frontward, coins in the temporary storage unit 571 are stored in the cassette 270. A door (not shown) is disposed at the front surface of the money changer 20, and the cassette 270 is mounted and dismounted with the door being opened.

Two storage units 573 (573*a* and 573*b*) are disposed inside the money changer 20. A switching member 541 is disposed between the temporary storage unit 571 moved rearward and the storage units 573. The switching member 541 is movable in the front-rear direction as shown by an arrow. When the temporary storage unit 571 is moved rearward, if the switching member 541 is at the frontward position as shown by a solid line in FIG. 9, the coins in the temporary storage unit 571 are stored in the storage unit 573*b*. If the switching member 541 is at the rearward position as shown by a broken line in FIG. 9, the coins in the temporary storage unit 571 are stored in the storage unit 573*a*.

According to the denominations and the number of coins recognized and counted by the recognition unit 550, the position of the switching member 541 and the moving direction of the temporary storage unit 571 are controlled, whereby the coins can be stored in any of the cassette 270, the storage unit 573*a*, and the storage unit 573*b*. The store clerk dismounts, from the money changer 20, the cassette 270 in which the coins have been stored. Thus, the cassette 270 can be used for replenishing the change dispenser 30 or the money recycler 40 with coins.

The management apparatus 10 estimates a denomination that is likely to be insufficient in the change dispenser 30, based on change (transition) in the inventory amount of the change dispenser 30. The management apparatus 10 notifies the money changer 20 of information of the denomination estimated to be insufficient. In the depositing process, if coins of the notified denomination are included in the coins stored in the temporary storage unit 571, the money changer 20 stores, in the cassette 270, the coins in the temporary storage unit 571. Meanwhile, if coins of the notified denomination are not included in the coins stored in the temporary storage unit 571, the coins in the temporary storage unit 571 are stored in the storage unit 573. Thus, when the change dispenser 30 needs to be replenished with coins, the change dispenser 30 can be replenished with the coins in the cassette 270 of the money changer 20.

Whether coins are to be stored in the cassette 270 or the storage unit 573 may be determined based on the number of coins. For example, when 10 or more coins of the denomination notified from the management apparatus 10 are included in the coins stored in the temporary storage unit 571, the coins in the temporary storage unit 571 are stored in the cassette 270. Otherwise, the coins are stored in the storage unit 573. For another example, the determination may be made based on the percentage regarding the number of coins. For example, when 50% or more of coins stored in the temporary storage unit 571 are coins of the denomination notified from the management apparatus 10, the coins in the temporary storage unit 571 are stored in the cassette 270. Otherwise, the coins are stored in the storage unit 573. It can be set that the determination is made based on both the number of coins and the percentage regarding the number of coins.

Figure 10A:
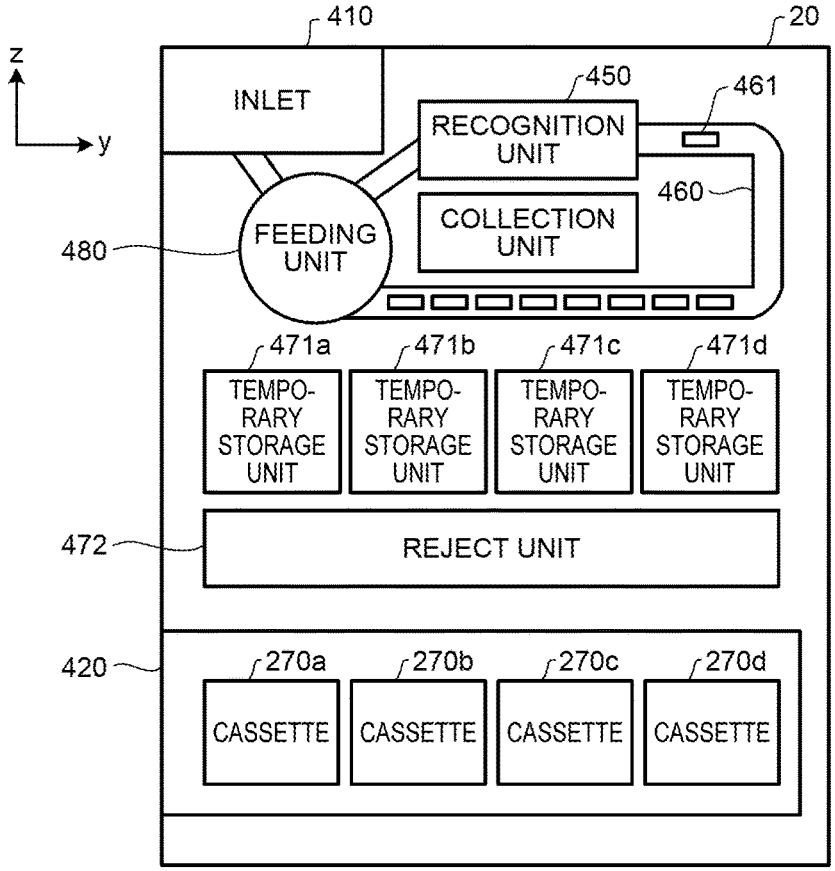
FIG. 10A schematically shows another example of a money changer.
Figure 10B:
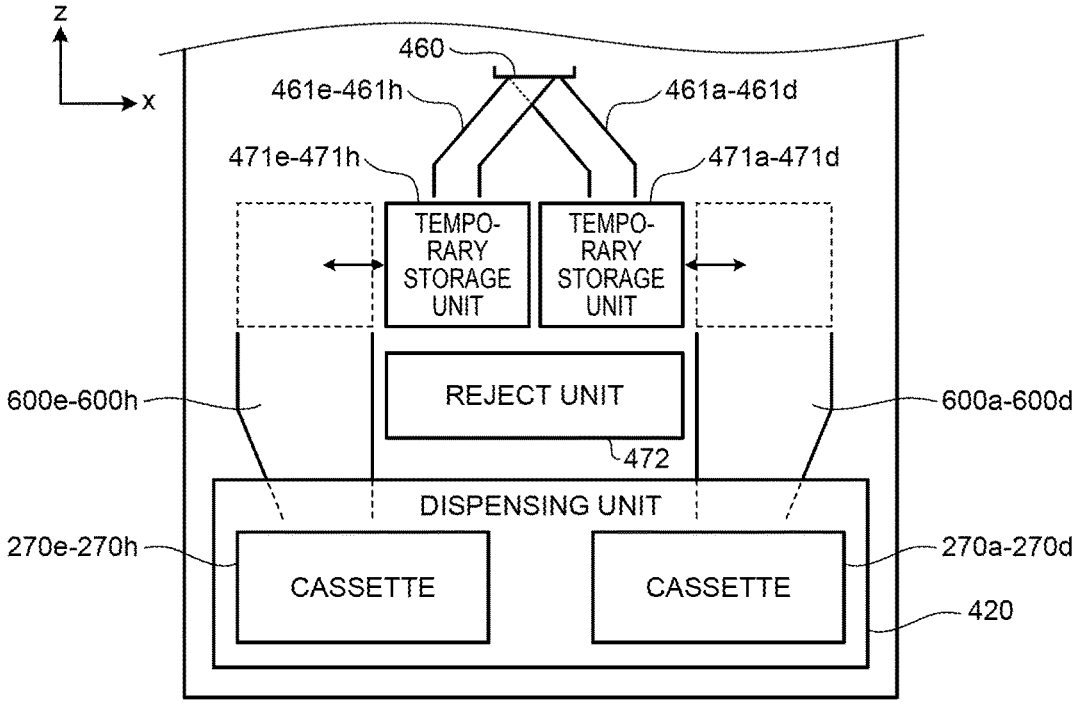
FIG. 10B schematically shows the money changer.

FIGS. 10A and 10B schematically show another example of the money changer 20. The money changer 20 shown in FIGS. 10A and 10B has a configuration similar to that of the money recycler 40 shown in FIGS. 8A and 8B. Specifically, the money changer 20 is obtained by excluding the chutes 463 and the storage units 473 from the configuration shown in FIG. 8, and adding a plurality of cassettes 270 (270*a* to 270*h*) corresponding to the temporary storage units 471, mountable and dismountable with respect to the dispensing unit 420. Furthermore, chutes 600 (600*a* to 600*h*) connecting the cassettes 270*a* to 270*h* to the temporary storage units 471*a* to 471*h* respectively are provided to realize the money changer 20 shown in FIGS. 10A and 10B. In the money changer 20 shown in FIGS. 10A and 10B, the same components as those shown in FIGS. 8A and 8B are denoted by the same reference numerals, and description thereof is omitted.

In the money changer 20 shown in FIGS. 10A and 10B, coins, which have been deposited by a customer for money changing, are stored into the plurality of temporary storage units 471 for each denomination, whereby the coins can be stored in the plurality of cassettes 270 for each denomination. After the number of coins stored in each cassette 270 has reached a predetermined number, the money changer 20 stores coins in the reject unit 472, whereby the predetermined number of coins can be stored in each of the cassettes 270*a* to 270*h*. That is, the money changer 20 can store, in each of the cassettes 270*a* to 270*h*, a predetermined number of coins of a predetermined denomination.

For example, the money changer 20 stores coins into the cassettes 270*a* to 270*h* for each denomination. The money changer 20 can store coins required for replenishing the change dispensers 30*a* to 30*c*, into different cassettes 270. Specifically, the management apparatus 10 monitors the inventory amounts of the change dispensers 30*a* to 30*c*, and notifies the money changer 20 of denominations and the number of coins that can be stored in each of the change dispensers 30*a* to 30*c*. The money changer 20 stores, into a cassette 270, the notified number of coins of the notified denomination.

For example, the management apparatus 10 notifies the money changer 20 to prepare, for the first change dispenser 30*a*, ten 500-JPY (Japanese Yen) coins and twenty 100-JPY coins. Upon receiving this notification, the money changer 20 assigns the cassette 270*a* to the first change dispenser 30*a*, and stores 500-JPY coins and 100-JPY coins into the cassette 270*a* every time the coins are deposited. Coins of other denominations are stored into other cassettes 270*b* to 270*h* or the reject unit 472. When the number of 500-JPY coins stored in the cassette 270*a* has reached ten, the money changer 20 no longer stores 500-JPY coins into the cassette 270*a*, and stores 500-JPY coins into the other cassettes 270*b* to 270*h* or the reject unit 472. Likewise, when the number of 100-JPY coins has reached twenty, the money changer 20 no longer stores 100-JPY coins into the cassette 270*a*, and stores 100-JPY coins into the other cassettes 270*b* to 270*h* or the reject unit 472. Thus, the money changer 20 shown in FIGS. 10A and 10B can store, into the plurality of cassettes 270, the notified numbers of coins of the notified denominations, according to the instruction of the management apparatus 10. Likewise, the management apparatus 10 can store coins for the second change dispenser 30*b* into the cassette 270*b*, and can store coins for the third change dispenser 30*c* into the cassette 270*c*. Thus, when replenishing the change dispensers 30*a* to 30*c* with coins, the store clerk only has to dismount the corresponding cassettes 270*a* to 270*c* from the money changer 20 and mount them to the change dispensers 30*a* to 30*c*.

Determination of a money movement method by the management apparatus 10 will be described. The money processing system 1 shown in FIG. 2 can realize the money movement between the plurality of money changers 20, the plurality of change dispensers 30, and the money recycler 40. The management apparatus 10 determines a money movement method, with one or a plurality of apparatuses being sources and one or a plurality of apparatuses being destinations. Hereinafter, the operation of the management apparatus 10 will be described for a case where the first change dispenser 30*a* in which shortage of coins occurs is replenished with coins.

Figure 11:
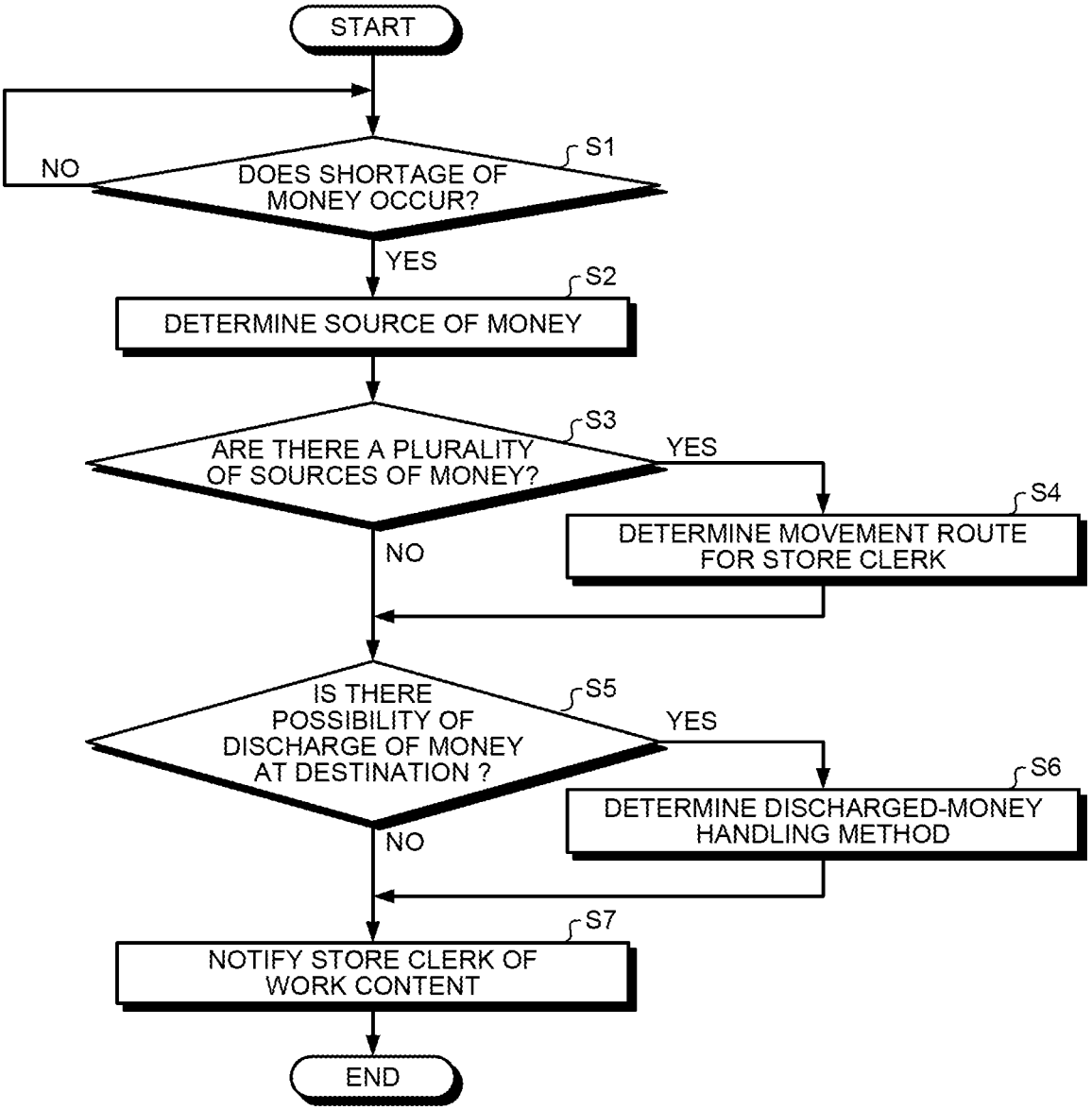
FIG. 11 is a flowchart showing processing of determining a coin movement method upon detecting shortage of coins in a money handling apparatus.

FIG. 11 is a flowchart showing processing of determining a coin movement method upon detecting shortage of coins in a money handling apparatus. The management apparatus 10 manages the inventory amounts of the money changers 20, the change dispensers 30, and the money recycler 40. The management apparatus 10 monitors whether or not the number of money for each denomination stored in each apparatus is equal to or less than a predetermined number, that is, whether or not shortage of money occurs (No in step S1). Upon detecting shortage of coins in the first change dispenser 30*a* (Yes in step S1), the management apparatus 10 determines a coin movement method for replenishing the first change dispenser 30*a* with the deficient number of coins.

The management apparatus 10 determines denominations and the number of coins to replenish the first change dispenser 30*a*. For example, it is assumed that shortage of 500-JPY coins occurs in the first change dispenser 30*a* and the management apparatus 10 determines to replenish the first change dispenser 30*a* with twenty 500-JPY coins. Subsequently, the management apparatus 10 determines an apparatus to be a source of coins (step S2). The management apparatus 10 determines a source apparatus of money, based on at least one of the present inventory amounts of the respective apparatuses, changes (transitions) in the inventory amounts of the respective apparatuses, setting of priority levels, and setting of options.

For example, it is assumed that, in order to continue the checkout process at the checkout counter, the priority level of the change dispenser 30 is set low while the priority level of the money changer 20, which performs only depositing without performing dispensing, is set high. The management apparatus 10 checks the present inventory amounts of the three money changers 20*a* to 20*c* whose priority levels are high. When a money changer 20, which stores the largest number of 500-JPY coins to replenish the first change dispenser 30*a*, is the second money changer 20*b*, the management apparatus 10 determines the second money changer 20*b* as a source of coins.

For example, when the first money changer 20*a* and the second money changer 20*b* store the same number of 500-JPY coins, the management apparatus 10 checks changes of the past inventory amounts of these apparatuses. For example, when more 500-JPY coins have been deposited in the second money changer 20*b* than in the first money changer 20*a* on the day, the management apparatus 10 determines the second money changer 20*b* as a source of coins.

When all twenty 500-JPY coins to replenish the first change dispenser 30*a* can be moved from the second money changer 20*b* (No in step S3), the management apparatus 10 determines whether or not there is a possibility of discharge of coins from the first change dispenser 30*a* that is replenished with coins (step S5).

For example, it is assumed that the second money changer 20*b* has the configuration shown in FIG. 9, and 100-JPY coins and twenty or more 500-JPY coins coexist in the cassette 270. The cassette 270 is mounted to the first change dispenser 30*a*, and the first change dispenser 30*a* is replenished with coins fed out from the mounted cassette 270. There is a possibility that 100-JPY coins are fed out from the cassette 270 before twenty 500-JPY coins has been fed out from the cassette 270. Since the 100-JPY coins are not used for the replenishment, the 100-JPY coins are discharged to the outlet 220 of the first change dispenser 30*a*. Therefore, the management apparatus 10 determines that there are coins to be discharged from the first change dispenser 30 when the first change dispenser 30 is replenished with coins (Yes in step S5).

Upon determining that there are coins to be discharged from the destination apparatus, the management apparatus 10 determines a method for handling the discharged coins (step S6). For example, when thirty 500-JPY coins and ten 100-JPY coins are stored in the cassette 270, the ten 100-JPY coins, at the maximum, may be discharged from the first change dispenser 30*a* while twenty 500-JPY coins are fed out to replenish the first change dispenser 30*a*. The management apparatus 10 checks the inventory amount of 100-JPY coins in the first change dispenser 30*a*. If storing the ten 100-JPY coins in the first change dispenser 30*a* does not pose a problem, the management apparatus 10 determines to store the 100-JPY coins in the first change dispenser 30*a*. Meanwhile, when all or some of the ten 100-JPY coins cannot be stored in the first change dispenser 30*a*, the management apparatus 10 checks whether or not the 100-JPY coins can be stored in another apparatus. For example, the management apparatus 10 checks the inventory amounts in order from the apparatus closest to the first change dispenser 30*a*. When the 100-JPY coins discharged from the first change dispenser 30*a* can be stored in the second change dispenser 30*b*, the management apparatus 10 determines to store the 100-JPY coins in the second change dispenser 30*b*.

After determining the source of coins for replenishment and the handling method for discharged coins, the management apparatus 10 guides the store clerk to perform the coin movement method (step S7), and ends the processing shown in FIG. 11. For example, the guidance to the store clerk is performed by the display unit of the management apparatus 10.

Figure 12:
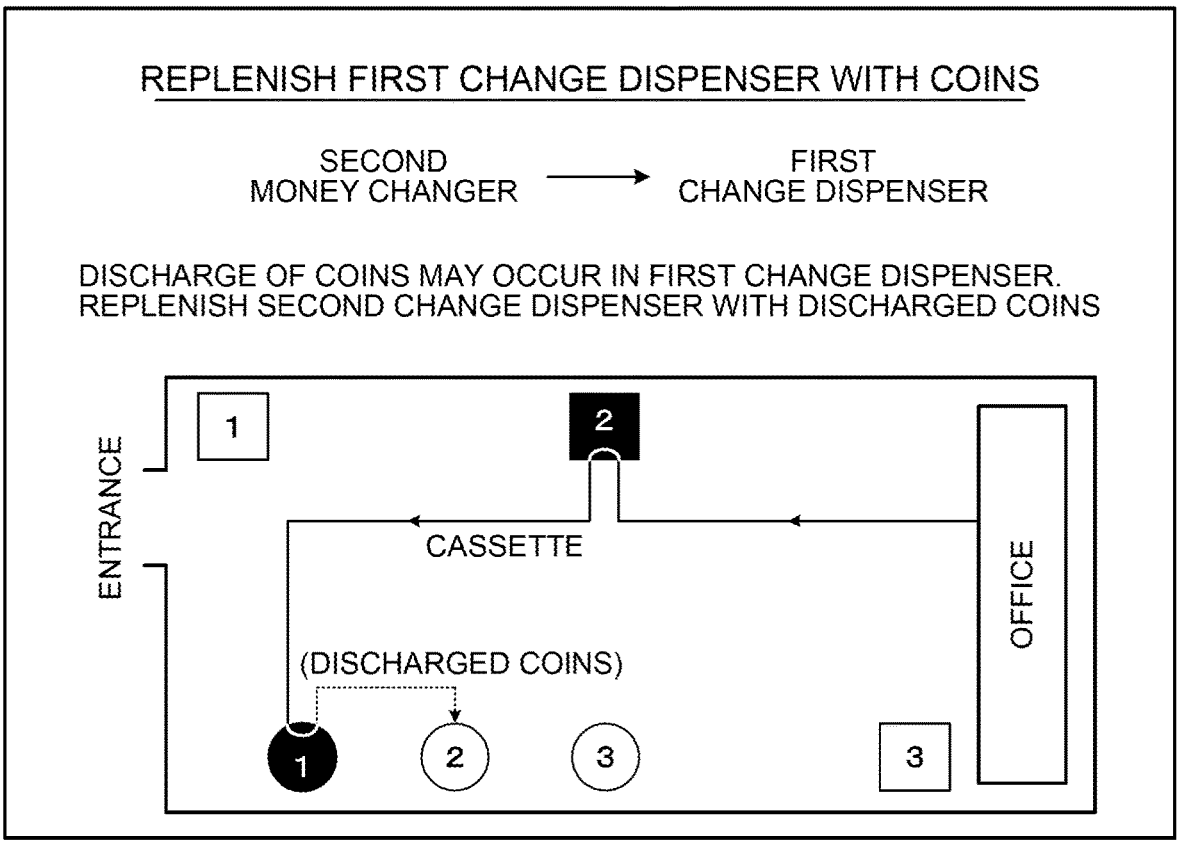
FIG. 12 shows an example of a screen that guides a coin movement method.

FIG. 12 shows an example of a screen that shows how to perform a coin movement method. FIG. 12 shows a case where the management apparatus 10 has determined that coins should be moved from the second money changer 20*b* to the first change dispenser 30*a*, and if coins are discharged from the first change dispenser 30*a*, the discharged coins should be stored into the second change dispenser 30*b*.

As shown in FIG. 12, the store clerk is notified to dismount the cassette 270 from the second money changer 20*b*, and mount the cassette 270 to the first change dispenser 30*a* to replenish with coins of the cassette 270. At this time, the store clerk is notified that discharge of coins may occur in the first change dispenser 30*a*. The store clerk is also notified that, if coins are discharged, these coins should be stored in the second change dispenser 30*b*.

On the screen, a plan view of the store 3 is displayed, and a movement route for the store clerk, who has checked the above notifications on the management apparatus 10 in the back office, is shown by an arrow. In the example shown in FIG. 12, numerals 1 to 3 enclosed in circles indicate the first change dispenser 30*a* to the third change dispenser 30*c* at the checkout counter, and numerals 1 to 3 enclosed in rectangles indicate the first money changer 20*a* to the third money changer 20*c*.

The store clerk moves along the route displayed on the screen of the management apparatus 10. The store clerk dismounts the cassette 270 from the second money changer 20*b*, and moves to the installation place of the first change dispenser 30*a* while carrying the cassette 270. The store clerk mounts the cassette 270 to the first change dispenser 30*a* and replenishes the first change dispenser 30*a* with coins of the cassette 270. At this time, if coins are discharged to the outlet 220 of the first change dispenser 30*a*, the store clerk replenishes the second change dispenser 30*b* with these discharged coins from the inlet 210 of the second change dispenser 30*b*.

For example, in a case where the management apparatus 10 has determined that coins not to be used for replenishment, which are fed out from the cassette 270 while the first change dispenser 30 is replenished with coins, should be stored in the storage unit 271 of the first change dispenser 30*a*, the store clerk is notified, on the screen shown in FIG. 12, that no coin will be discharged. In this case, when coins not to be used for replenishment are fed out from the cassette 270, these coins are not discharged to the outlet 220 but stored in the corresponding storage unit 271 inside the first change dispenser 30*a*.

When a plurality of sources of money have been determined in step S2 in FIG. 11 (Yes in step S3), the management apparatus 10 determines a movement route so as to minimize the movement distance of the store clerk (step S4). For example, when coins needs to be moved from the first money changer 20*a* and the second money changer 20*b* to replenish the first change dispenser 30*a* with the coins, the movement distance of the store clerk is increased if the store clerk dismounts the cassette 270 from the first money changer 20*a* and then moves to the second money changer 20*b*. Therefore, the management apparatus 10 determines the movement route for the store clerk to be the second money changer 20*b*, the first money changer 20*a*, and the first change dispenser 30*a* in this order.

If no coin will be discharged from the first change dispenser 30*a* when the first change dispenser 30*a* is replenished with coins (No in step S5), the management apparatus 10 guides the store clerk to perform the determined coin movement method (step S7), and ends the processing shown in FIG. 11.

Figure 13:
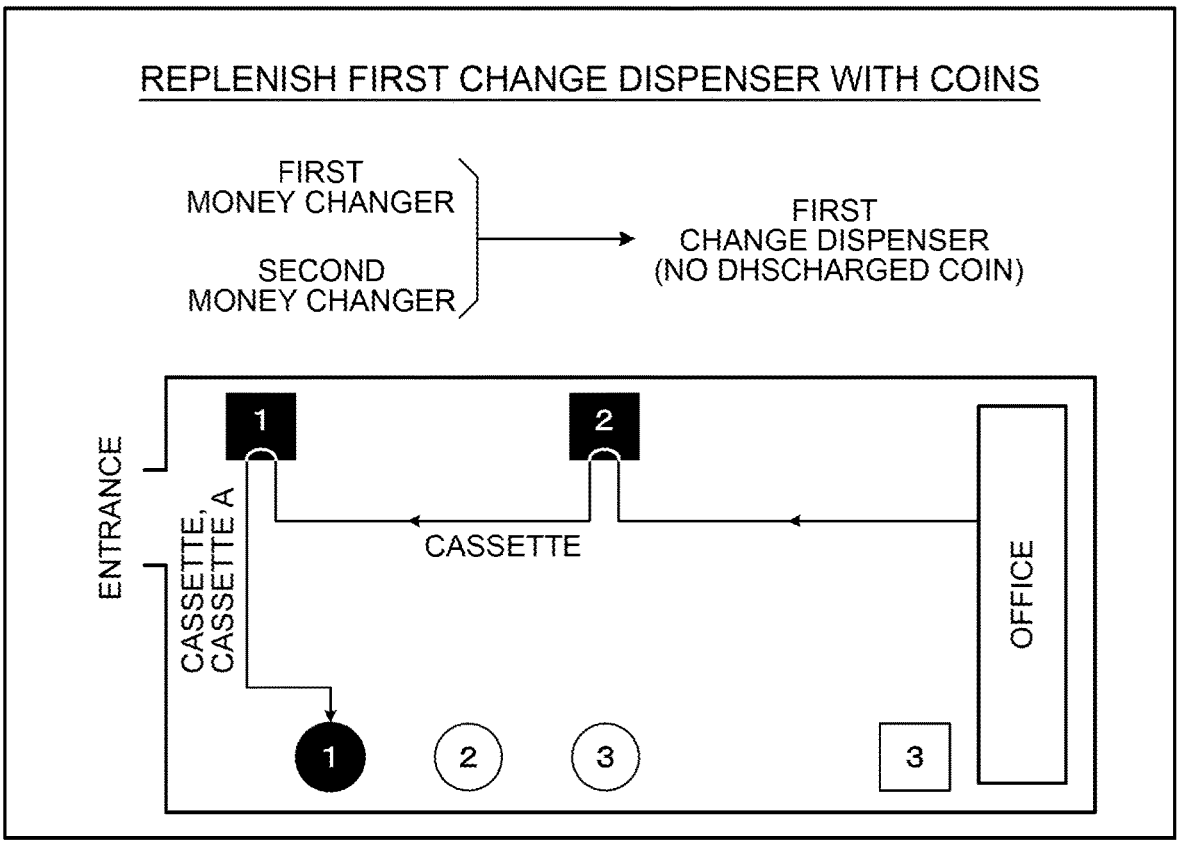
FIG. 13 shows another example of a screen that guides a coin movement method.

FIG. 13 shows another example of a screen that shows how to perform a coin movement method. FIG. 13 shows a case where the management apparatus 10 has determined that coins should be moved to the first change dispenser 30*a* from both the first money changer 20*a* and the second money changer 20*b*. In this example, when the first change dispenser 30*a* is replenished with coins, no coin will be dispensed from the first change dispenser 30*a*.

As shown in FIG. 13, the store clerk is notified to replenish the first change dispenser 30*a* with coins by using two cassettes, i.e., the cassette 270 dismounted from the first money changer 20*a* and the cassette 270 dismounted from the second money changer 20*b*. In addition, the store clerk is notified that no coin will be discharged from the first change dispenser 30*a* when the first change dispenser 30*a* is replenished with coins.

When the second money changer 20*b* has the configuration shown in FIG. 9 and includes only one cassette 270, only information that instructs dismount of the cassette 270 is displayed on the screen. Meanwhile, when the first money changer 20*a* has the configuration shown in FIG. 10 and includes a plurality of cassettes 270, information indicating which one of the cassettes 270 should be dismounted is displayed on the screen. In the example shown in FIG. 13, since the cassette 270*a* among the cassettes 270*a* to 270*h* is to be dismounted, "cassette A" is displayed on the screen.

The store clerk, who has checked the screen on the management apparatus 10 in the back office, moves along the movement route displayed on the screen. The store clerk dismounts the cassette 270 from the second money changer 20*b*. The store clerk moves to the installation place of the first money changer 20*a*, and dismounts the cassette 270*a* corresponding to the "cassette A" shown in FIG. 13. The store clerk moves to the installation place of the first money changer 20*a*, and mounts the cassette 270 dismounted from the second money changer 20*b* and the cassette 270*a* dismounted from the first money changer 20*a* to the first change dispenser 30*a* in turn, thereby replenishing the first money changer 20*a* with coins.

Even when shortage of money simultaneously occurs in a plurality of apparatuses, the management apparatus 10 can determine a money movement method for replenishing the respective apparatuses with money. For example, when shortage of coins is detected in the first change dispenser 30*a* and the third change dispenser 30*c*, the management apparatus 10 determines a coin movement method for replenishing the two change dispensers 30*a* and 30*c* with coins, and notifies the store clerk of the determined method. The management apparatus 10 determines the money movement method so as to minimize the number of source apparatuses and minimize the movement distance of the store clerk. When two change dispensers 30*a* and 30*c* can be replenished with money by using the cassette 270 of the first money changer 20*a* or the cassette 270 of the third money changer 20*c*, the management apparatus 10 determines the third money changer 20*c* as a source apparatus to minimize the movement distance of the store clerk. The management apparatus 10 guides the store clerk to perform the determined money movement method.

Figure 14:
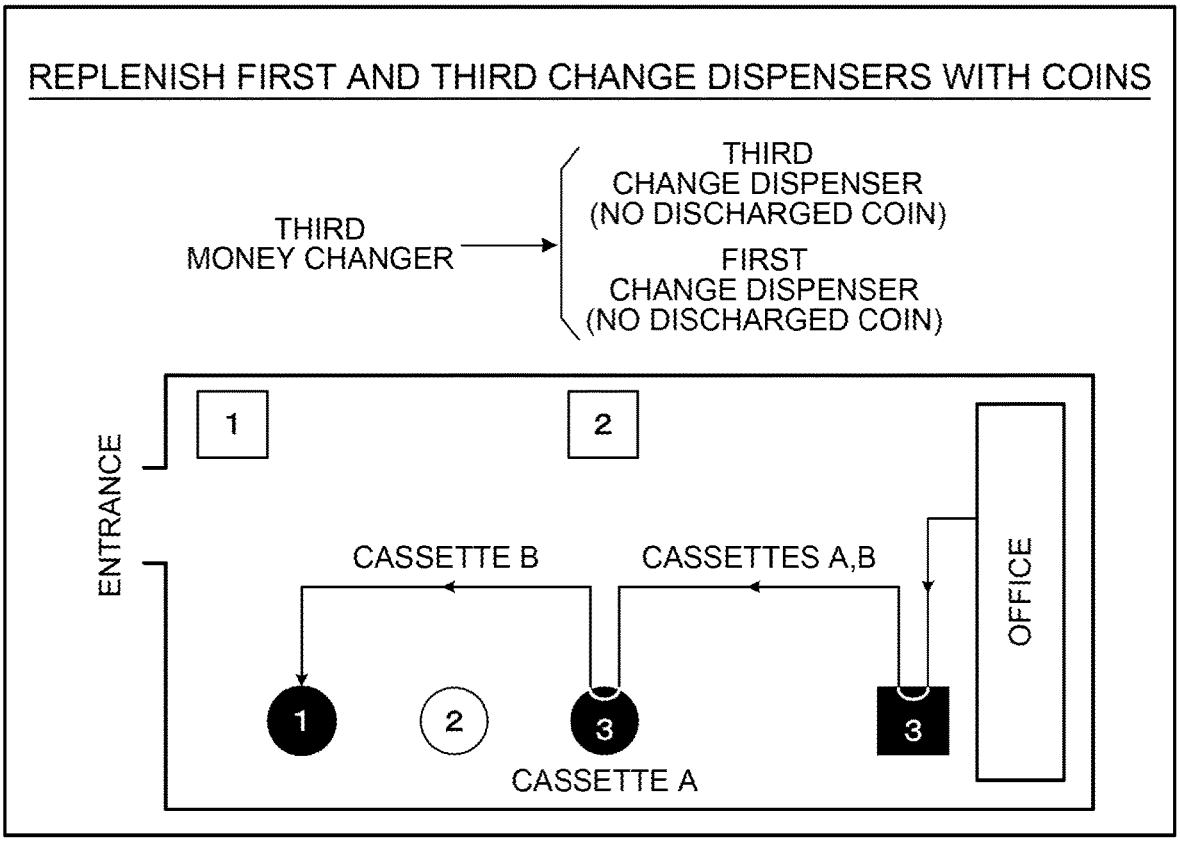
FIG. 14 shows still another example of a screen that guides a coin movement method.

FIG. 14 shows still another example of a screen that shows how to perform a coin movement method. On the screen, the store clerk is notified to dismount two cassettes 270 from the third money changer 20*c*, mount one of the cassettes 270 to the third change dispenser 30*c* to replenish with coins, and mount the other cassette 270 to the first change dispenser 30*a* to replenish with coins. The store clerk is also notified that no coin is discharged from the third change dispenser 30*c* and the first change dispenser 30*a* when the apparatuses 30*c* and 30*a* are replenished with coins.

When the third money changer 20*c* has the configuration shown in FIG. 10 and includes a plurality of cassettes 270, information about which cassette should be dismounted is displayed on the screen. When the plurality of cassettes 270 are mounted to different apparatuses to move money, information indicating the destinations of the respective cassettes is displayed on the screen. In the example shown in FIG. 14, among the plurality of cassettes 270*a* to 270*h* included in the third money changer 20*c*, the cassette 270*a* and the cassette 270*b* are to be dismounted. Therefore, on the screen, "cassettes A, B" is displayed above the movement route from the third money changer 20*c* to the third change dispenser 30*c*. The cassette 270*a* (cassette A) is mounted to the third change dispenser 30*c*, and the cassette 270*b* (cassette B) is mounted to the first change dispenser 30*a*. Therefore, on the screen, "cassette A" is displayed beneath the numeral indicating the third change dispenser 30*c*, and "cassette B" is displayed above the movement route from the third change dispenser 30*c* to the first change dispenser 30*a*.

The store clerk, who has checked the screen shown in FIG. 14 on the management apparatus 10 in the back office, moves along the route displayed on the screen. The store clerk dismounts the cassette 270*a* and the cassette 270*b* from the third money changer 20*c*, and moves to the installation place of the third change dispenser 30*c* while carrying two cassettes 270*a* and 270*b*. The store clerk mounts the cassette 270*a* to the third change dispenser 30*c* to replenish with coins of the cassette 270*a*. Subsequently, the store clerk moves to the installation place of the first change dispenser 30*a* while carrying one cassette 270*b*. The store clerk mounts the cassette 270*b* to the first change dispenser 30*a* to replenish with coins of the cassette 270*b*.

As described above, the management apparatus 10 determines a source and a destination of money and a money movement route, and guides the store clerk to perform the money movement method. When a plurality of cassettes 270 are used for movement of money, the management apparatus 10 notifies the store clerk of information that specifies each cassette 270. When the store clerk needs to visit a plurality of apparatuses in a particular order, the management apparatus 10 notifies a movement route and guides the store clerk. The store clerk moves as guided by the management apparatus 10, and performs dismounting/mounting of a cassette 270 at each apparatus, to complete movement of money. Thus, movement of money between the apparatuses is facilitated, and a burden on the store clerk is reduced.

Figure 15:
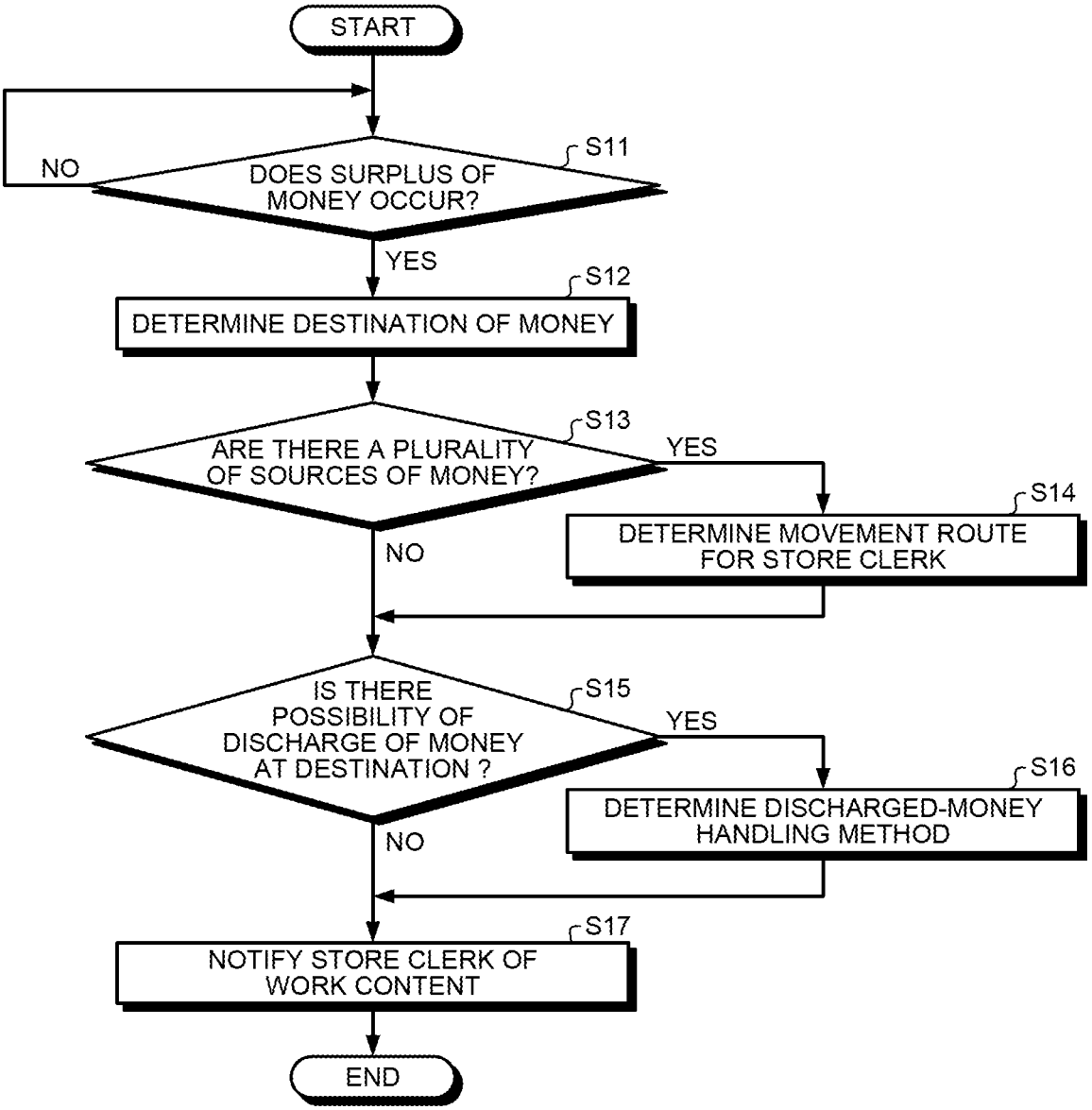
FIG. 15 is a flowchart showing processing of determining a money movement method upon detecting surplus of coins.

When surplus of money occurs, the management apparatus 10 determines a money movement method and guides the store clerk to perform the money movement method, in a similar manner to that for shortage of money. FIG. 15 is a flowchart of processing for determining a coin movement method upon detecting surplus of coins. The management apparatus 10 manages the inventory amounts of the money changers 20, the change dispensers 30, and the money recycler 40. The management apparatus 10 monitors whether or not the number of money for each denomination stored in each apparatus is equal to or more than a predetermined number, that is, whether or not surplus of money occurs (No in step S11). Upon detecting surplus of coins in an apparatus (Yes in step S11), the management apparatus 10 determines a coin movement method for collecting surplus coins and moving the coins to another apparatus.

The management apparatus 10 determines denominations and the number of money to be collected, and determines an apparatus to be a destination of the collected money (step S12). The management apparatus 10 determines the destination of the money based on at least one of the present inventory amounts of the respective apparatuses, changes (transitions) in the past inventory amounts of the respective apparatuses, setting of priority levels, and setting of options.

The management apparatus 10 checks the inventory amounts in order from an apparatus having the highest priority level, and searches for an apparatus in which the collected money can be stored. If a plurality of apparatuses that can store the collected money are present among a plurality of apparatuses of the same priority level, the management apparatus 10 determines, as a destination, an apparatus having the smallest number of money at present for the same denomination as that of the collected money. If the plurality of apparatuses have the same number of money stored therein, the management apparatus 10 determines a destination apparatus, based on changes of the past inventory amounts of these apparatuses.

If there is no apparatus (destination) in which all the collected money can be stored, the management apparatus 10 determines a plurality of apparatuses as destinations. When the destination of the collected money is a single apparatus (No in step S13), the management apparatus 10 determines whether there is a possibility of discharge of money in the destination apparatus (step S15). When there are a plurality of apparatuses as destinations of the collected money (Yes in step S13), the management apparatus 10 determines a movement route for the store clerk (step S14), and determines whether there is a possibility of discharge of money in each destination apparatus (step S15).

When no money will be discharged from each destination apparatus (No in step S15), the management apparatus 10 notifies the store clerk of the destination(s) of the collected money and the movement route for the store clerk (step S17). If there is a possibility of discharge of money from the destination apparatus (Yes in step S15), the management apparatus 10 determines a discharged money handling method (step S16). The discharged money handling method is determined in a similar manner to step S6 in FIG. 11. That is, when the money to be discharged can be stored in the destination apparatus, the management apparatus 10 determines to store the money in the destination apparatus without discharging the money. Otherwise, the management apparatus 10 selects another apparatus that can store the discharged money. The management apparatus 10 determines a destination of collected money and a movement route for the store clerk, and determines, according to need, a handling method for money that will be discharged from the destination apparatus. The management apparatus 10 guides the store clerk to perform the money movement method (step S17), and ends the processing shown in FIG. 15.

Guidance for a movement method for collected money is performed in a similar manner to the guidance for replenishment. Like the guidance screen for replenishment shown in FIG. 12 to FIG. 14, a movement route for the store clerk is displayed on a plan view of the store 3. In addition, the store clerk is notified of information of a cassette 270 to be dismounted from each apparatus, information of a cassette 270 to be mounted to each apparatus, and information regarding a discharged coin handling process. While moving in the store 3 as determined by the management apparatus 10, the store clerk collects coins from an apparatus in which surplus of coins occurs, and stores the collected coins into a destination apparatus.

As described above, the management apparatus 10 detects shortage and surplus of money, and determines a money movement method. The management apparatus 10 notifies the store clerk of the determined movement route and content of work for the money movement method. Thus, a burden on the store clerk who is in charge of movement of money can be reduced.

When surplus money of the money changer 20 is used as change by the change dispenser 30, the number of requests to a CIT company for collection of surplus money can be reduced. When shortage of money for change in the change dispenser 30 is replenished with money collected from the money changer 20, the number of requests to the CIT company for delivery of money for change can also be reduced.

In FIG. 9 and FIG. 10 of the present embodiment, the money changer 20 performs only depositing of coins. However, the money changer 20 may handle both coins and banknotes, or the money changer 20 may perform dispensing in addition to depositing. For example, when the money changer 20 has the same configuration as the change dispenser 30 shown in FIG. 4 and FIGS. 5A, 5B or the money recycler 40 shown in FIG. 6 to FIGS. 8A, 8B, the money changer 20 can dispense money.

In FIG. 11 to FIG. 14 of the present embodiment, coins are moved between the money changer 20 and the change dispenser 30 by using the cassette 270. However, coins may be moved between the money changers 20 or between the change dispensers 30. Moreover, coins may be moved between the money recycler 40 and the money changer 20, or between the money recycler 40 and the change dispenser 30.

The money movement method of the present embodiment is not limited to a method using a cassette, and may be a method in which money is discharged from an outlet of a source apparatus and put in a container, the container is carried to a destination apparatus, and the money taken out from the container is stored into the destination apparatus from an inlet. For example, when the source of coins is the change dispenser 30, the coins can be discharged from the outlet 220. When the destination of coins is the change dispenser 30, the coins can be stored into the apparatus from the inlet 210.

Money to be moved is not limited to coins only, and may be banknotes only or both banknotes and coins. When banknotes are included in money to be handled, as described above for coins, the management apparatus 10 determines a source apparatus, a destination apparatus, a movement route, and a handling method for banknotes to be discharged from each apparatus during the movement of money, and notifies the store clerk of them.

In the examples shown in FIGS. 13 and 14 of the present embodiment, the store clerk moves while carrying a plurality of cassettes 270. However, the store clerk may visit a plurality of apparatuses to move money while carrying a single cassette 270. For example, it is assumed that the first change dispenser 30*a* needs to be replenished with fifty 500-JPY coins. The management apparatus 10 may determine that a cassette 270 in which thirty 500-JPY coins are being stored should be dismounted from the third money changer 20*c* and mounted to the dispensing unit 420 of the money recycler 40 to store twenty 500-JPY coins, corresponding to a deficiency, into the cassette 270. In this case, the store clerk visits the third money changer 20*c*, the money recycler 40, and the first change dispenser 30*a* in this order while carrying the single cassette 270. The store clerk can prepare the cassette 270 including fifty 500-JPY coins and mount the cassette 270 to the first change dispenser 30*a* to replenish with fifty 500-JPY coins. The same applies to the case of collecting money. For example, it is assumed that fifty 500-JPY coins being stored in the cassette 270 of the first money changer 20*a* needs to be collected. The management apparatus 10 may determine that the cassette 270 should be mounted to the third change dispenser 30*c* to store twenty 500-JPY coins to this apparatus 30*c*, and then the cassette 270 should be mounted to the second money changer 20*b* to store the remaining thirty 500-JPY coins to this apparatus 20*b*. In this case, the store clerk visits the second money changer 20*b* and the third change dispenser 30*c* in this order while carrying the cassette 270 dismounted from the first money changer 20*a*. The store clerk can collect coins from the first change dispenser 30*a*, and stores the collected coins into the second money changer 20*b* and the third change dispenser 30*c*.

In the present embodiment, collection of money and replenishment of money have been separately described. However, collection of money and replenishment of money can be simultaneously performed. For example, money collected from one or a plurality of apparatuses can be used for replenishment of one or a plurality of apparatuses with money. After the management apparatus 10 has determined a money movement method for replenishment as described above, the management apparatus 10 determines a money movement method for collection, based on the inventory amounts of money in the respective apparatuses after the replenishment, whereby replenishment of money and collection of money can be simultaneously performed. Likewise, after the management apparatus 10 has determined a money movement method for collection, the management apparatus 10 determines a money movement method for replenishment, based on the inventory amounts of money in the respective apparatuses after the collection, whereby collection of money and replenishment with money can be simultaneously performed. It is possible that money of a certain denomination is collected from a money handling apparatus, and simultaneously, the same money handling apparatus is replenished with money of another denomination.

In the present embodiment, money for replenishment and money for collection are determined based on the denominations thereof. However, determination of money to be moved can be performed based on various kinds of information of money. Based on the kind of money recognized by the recognition unit of the money handling apparatus, the kind of money to be moved is determined. Specifically, money to be moved can be determined based on at least one of the recognition results of denomination, fitness, and authenticity of the money. Denominations may include the kinds of currency such as Japanese currency, American currency, etc.

In the present embodiment, the money processing system 1 is composed of the management apparatus 10 and a plurality of kinds of money handling apparatuses. However, this configuration is conceptually functional, and therefore, the money processing system 1 is not physically limited to the configuration. For example, in the example shown in FIG. 2, the money recycler 40 may implement the entirety or part of the function and operation of the management apparatus 10 described above. The manners of division and integration of the respective devices are not limited to the above examples, and the entirety or part of the devices may be functionally or physically divided or integrated in any unit, according to various loads and/or usage states.

The money processing system 1 including a plurality of money handling apparatuses further includes a management apparatus 10 configured to detect a money handling apparatus that requires movement of money. The management apparatus 10 is configured to select, from among the plurality of money handling apparatuses, one or a plurality of money handling apparatuses to move the money between the detected money handling apparatus and the selected one or the plurality of handling apparatuses.

The management apparatus 10 is configured to select the one or the plurality of money handling apparatuses from among money handling apparatuses that have previously been set as candidates of the movement of money for the money handling apparatus that requires transfer of money.

The management apparatus 10 is configured to determine a transfer route along which the money is transferred.

The management apparatus 10 is configured to determine whether or not there is money that will not be stored in a first money handling apparatus selected as a destination of the movement of money when money is moved to the first money handling apparatus. If there is money that will not be stored in the first money handling apparatus, the management apparatus 10 is configured to further select a second money handling apparatus to be a destination of the money that will not be stored in the first money handling apparatus.

The management apparatus 10 is configured to select the one or the plurality of money handling apparatuses, based on denomination of the money to be moved and on inventory amounts of money of the denomination stored in the respective money handling apparatuses.

The management apparatus 10 is configured to select the one or the plurality of money handling apparatuses, based on priority levels set on the respective money handling apparatuses.

The management apparatus 10 is configured to select the one or the plurality of money handling apparatuses, based on a movement distance of a person who is in charge of the movement of money.

In the money processing system 1, the movement of money is performed by using a cassette that is mountable and dismountable with respect to the money handling apparatuses.

As described above, the management apparatus 10 can determine a money movement method using one or a plurality of apparatuses as sources of money, in order to replenish an apparatus in which shortage of money is detected, with money moved from another apparatus. The management apparatus 10 can determine a money movement method using one or a plurality of apparatuses as destinations of money, in order to collect money from an apparatus in which surplus of money has been detected and to move the money to another apparatus.

The management apparatus 10 determines a movement method so as to efficiently move money, based on at least one of the present inventory amounts of the respective apparatuses, changes in past inventory amounts of the respective apparatuses, settings of priority levels, and settings of options. Moving money among a plurality of money handling apparatuses installed in a store results in reduction in the number of requests to a CIT company for money transportation.

The management apparatus 10 can guide a store clerk, who is in charge of movement of money, to perform a money movement method. Thus, a burden, regarding movement of money, imposed on a person in charge can be reduced.

As described above, the money processing system and the money processing method according to the present invention are useful for easily moving money between a plurality of money handling apparatuses.

What is claimed is:

1. A money processing system comprising:

a plurality of money handling apparatuses; and a management apparatus configured to detect a money handling apparatus that requires movement of money, and select, from among the plurality of money handling apparatuses, at least one money handling apparatus to move the money between the detected money handling apparatus and the selected at least one money handling apparatus, wherein the management apparatus is configured to:

select, as the at least one money handling apparatus, at least one first money handling apparatus having a highest priority level among priority levels associated with the respective money handling apparatuses, and in response to an inability to move the money between the detected money handling apparatus and the at least one first money handling apparatus having the highest priority level, select, as the at least one money handling apparatus, at least one second money handling apparatus having a second highest priority level among the priority levels associated with the respective money handling apparatuses.

2. The money processing system according to claim 1, wherein the management apparatus is configured to select the at least one money handling apparatus from among money handling apparatuses that have previously been set as options for the money handling apparatus that requires the movement of money.

3. The money processing system according to claim 1, wherein the management apparatus determines a movement route along which the money is moved.

4. The money processing system according to claim 1, wherein:

the management apparatus is configured such that, when the management apparatus selects the at least one money handling apparatus as a destination of the money, the management apparatus determines whether a subset of the money will not be stored in the selected at least one money handling apparatus, and in response to determining that the subset of the money will not be stored in the selected at least one money handling apparatus, the management apparatus further selects at least one additional money handling apparatus to be a destination of the subset of the money that will not be stored in the at least one selected money handling apparatus.

5. The money processing system according to claim 1, wherein the management apparatus is configured to select the at least one money handling apparatus based on a denomination of the money to be moved and on inventory amounts of money of the denomination stored in the respective money handling apparatuses.

6. The money processing system according to claim 1, wherein the management apparatus is configured to select the at least one money handling apparatus based on a movement distance of a person in charge of the movement of money.

7. The money processing system according to claim 1, wherein the system further comprises a cassette that is mountable to and dismountable from the money handling apparatuses, wherein the cassette is configured to store the money during the movement of money.

8. The money processing system according to claim 1, wherein the management apparatus comprises an operation unit configured to set the priority levels.

9. The money processing system according to claim 8, wherein the management apparatus comprises a memory configured to store the priority levels.

10. The money processing system according to claim 1, wherein, priority levels associated with the at least one money handling apparatus include (i) a first priority level for selecting the at least one money handling apparatus as a destination money handling apparatus to which the money is to be moved from the detected money handling apparatus, and (ii) a second priority level for selecting a source money handling apparatus from which the money is to be moved to the detected at least one money handling apparatus.

11. The money processing system according to claim 1, wherein a first priority level is associated with a first type of money handling apparatuses, and wherein a second priority level is associated with a second type of money handling apparatuses.

12. The money processing system according to claim 11, wherein the first type of money handling apparatuses are change dispensers, and wherein the second type of money handling apparatuses are money changers.

13. The money processing system according to claim 1, wherein the management apparatus is configured to, when the at least one money handling apparatus comprises a plurality of money handling apparatuses having the same priority level, select a money handling apparatus based on inventory amounts of the respective plurality of money handling apparatuses having the same priority level.

14. The money processing system according to claim 13, wherein the management apparatus is configured to, when the at least one money handling apparatus comprises a plurality of money handling apparatuses having the same priority level and the same inventory amount, select a money handling apparatus based on changes of past inventory amounts of the respective plurality of money handling apparatuses having the same priority level and the same inventory amount.

15. The money processing system according to claim 13, wherein the management apparatus is configured to, when the at least one money handling apparatus comprises a plurality of money handling apparatuses having the same priority level and the same inventory amount, select a money handling apparatus based on changes of past inventory amounts of the respective plurality of money handling apparatuses having the same priority level and the same inventory amount.

16. The money processing system according to claim 1, wherein the management apparatus is a part of one of the plurality of money handling apparatuses.

17. A money processing method to be executed by a management apparatus, comprising:

detecting a money handling apparatus that requires movement of money; and selecting, from among a plurality of money handling apparatuses, at least one money handling apparatus to move the money between the detected money handling apparatus and the selected at least one money handling apparatus, which comprises:

selecting, as the at least one money handling apparatus, at least one first money handling apparatus having a highest priority level among priority levels associated with the respective money handling apparatuses, and in response to an inability to move the money between the detected money handling apparatus and the at least one first money handling apparatus having the highest priority level, selecting, as the at least one money handling apparatus, at least one second money handling apparatus having a second highest priority level among the priority levels associated with the respective money handling apparatuses.

18. A money processing system comprising:

a plurality of money handling apparatuses; and a management apparatus configured to detect a money handling apparatus that requires movement of money, and select, from among the plurality of money handling apparatuses, at least one money handling apparatus to move the money between the detected money handling apparatus and the selected at least one money handling apparatus, wherein the management apparatus is configured to select the at least one money handling apparatus based on priority levels associated with the respective money handling apparatuses, and the management apparatus is configured to, when the at least one money handling apparatus comprises a plurality of money handling apparatuses having the same priority level, select a money handling apparatus based on inventory amounts of the respective plurality of money handling apparatuses having the same priority level.

* * * * *